US008867963B2

(12) United States Patent
Tsuji et al.

(10) Patent No.: US 8,867,963 B2
(45) Date of Patent: Oct. 21, 2014

(54) DRIVING MECHANISM AND IMAGE FORMING APPARATUS COMPRISING THE SAME

(75) Inventors: Hirofumi Tsuji, Osaka (JP); Akihiro Yamaguchi, Osaka (JP)

(73) Assignee: Kyocera Document Solutions Inc., Osaka-Shi (JP)

( * ) Notice: Subject to any disclaimer, the term of this patent is extended or adjusted under 35 U.S.C. 154(b) by 224 days.

(21) Appl. No.: 13/218,509

(22) Filed: Aug. 26, 2011

(65) Prior Publication Data

US 2012/0051788 A1 Mar. 1, 2012

(30) Foreign Application Priority Data

Aug. 30, 2010 (JP) ..... 2010-192405

(51) Int. Cl.
*G03G 15/00* (2006.01)

(52) U.S. Cl.
CPC ..... *G03G 15/757* (2013.01); *G03G 15/755* (2013.01)
USPC ..... 399/167

(58) Field of Classification Search
CPC ..... G03G 15/757; G03G 15/755
USPC ..... 399/167
See application file for complete search history.

(56) References Cited

U.S. PATENT DOCUMENTS

| | | | | |
|---|---|---|---|---|
| 1,502,080 | A * | 7/1924 | Wilson | 105/101 |
| 4,977,708 | A * | 12/1990 | Kloft | 451/359 |
| 2007/0151830 | A1 * | 7/2007 | Kawamata | 198/813 |
| 2008/0178528 | A1 * | 7/2008 | Yoshida et al. | 49/332 |

FOREIGN PATENT DOCUMENTS

| | | | |
|---|---|---|---|
| JP | 11-122641 | A | 4/1999 |
| JP | 2004-100854 | | 4/2004 |
| JP | 2004-324801 | A | 11/2004 |
| JP | 2010037073 | A * | 2/2010 |

OTHER PUBLICATIONS

English translation of JP 2004-100854.
English Machine Translation of JP 11-122641.
English Machine Translation of JP 2004-324801.
A Communication form a foreign patent office for a counterpart foreign application dated Oct. 30, 2012.

* cited by examiner

*Primary Examiner* — Walter L Lindsay, Jr.
*Assistant Examiner* — Philip Marcus T Fadul
(74) *Attorney, Agent, or Firm* — Knobbe Martens Olson & Bear LLP

(57) ABSTRACT

The belt driving mechanism of the present invention includes: a driving pulley; a driven pulley; a looped transmission belt extended over the driving pulley and the driven pulley; a first holding member that bearing-supports and holds the driving pulley; a second holding member that bearing-supports and holds the driven pulley, and is combined with the first holding member; and a biasing member that biases the first holding member and the second holding member to be separated, in a state in which the first holding member and the second holding member are combined.

9 Claims, 16 Drawing Sheets

DRIVING MECHANISM AND IMAGE FORMING APPARATUS COMPRISING THE SAME

This application is based on and claims the benefit of priority from Japanese Patent Application No. 2010-192405, filed on Aug. 30, 2010, the content of which is incorporated herein by reference.

BACKGROUND OF THE INVENTION

1. Field of the Invention

The present invention relates to a driving mechanism that rotationally drives a pulley, and to an image forming apparatus comprising the same.

2. Related Art

Conventionally, an image forming apparatus such as a printer and a copying machine generally includes a photosensitive drum as an image carrier. The photosensitive drum includes: a photosensitive drum main body; and a shaft member that is disposed so as to penetrate the photosensitive drum main body in the rotation center of the photosensitive drum main body. A rotational driving force from a rotational driving unit is directly or indirectly transmitted to the shaft member, thereby rotationally driving the photosensitive drum.

As a driving mechanism that rotationally drives a photosensitive drum, for example, a driving mechanism is known, which includes a transmission belt extended over a pulley between an output shaft of a motor and a shaft member of a photosensitive drum in state in which the output shaft of the motor and the shaft member of the photosensitive drum are disposed in parallel with each other, and a rotational driving force of the motor is transmitted to the shaft member of the photosensitive drum via the transmission belt.

In such a driving mechanism, the transmission belt needs to be stably extended over the pulley in order to stably rotationally drive the pulley. If the transmission belt is not stably extended over the pulley, the transmission belt may meander or fall off the pulley. In contrast, the conventional art described above employs a configuration, in which a flange portion is created at the end portion of the pulley to restrict the transmission belt from meandering, and the end portion of the transmission belt is coated with resin to prevent abnormal noise from occurring when the end portion of the transmission belt and the flange portion are in contact with each other.

According to the conventional art described above, although the sliding noise of the transmission belt can be reduced, the end portion of the transmission belt is likely to slide. Moreover, in a driving mechanism (a speed reduction mechanism) that uses a transmission belt characterized in high rigidity and no engagement, the sliding at the end portion of the transmission belt may deteriorate the stability of the rotation of the pulley.

An object of the present invention is to provide a driving mechanism that transmits a rotational driving force via a transmission belt extended over a pulley, in which the transmission belt is stably extended over the pulley, and the pulley can be stably rotated.

In addition, another object of the present invention is to provide an image forming apparatus including the driving mechanism.

SUMMARY OF THE INVENTION

The present invention relates to a belt driving mechanism that includes: a driving pulley; a driven pulley; a looped transmission belt extended over the driving pulley and the driven pulley; a first holding member that bearing-supports and holds the driving pulley; a second holding member that bearing-supports and holds the driven pulley, and is combined with the first holding member; and a biasing member that biases the first holding member and the second holding member to be separated, in a state in which the first holding member and the second holding member are combined.

According to the present invention, in the driving mechanism that transmits a rotational driving force via the transmission belt extended over the pulley, it is possible to provide the belt driving mechanism, in which the transmission belt is stably extended over the pulley, and the pulley can be stably rotated.

Furthermore, the present invention can provide an image forming apparatus including the driving mechanism.

DETAILED DESCRIPTION OF THE INVENTION

Figure 1:
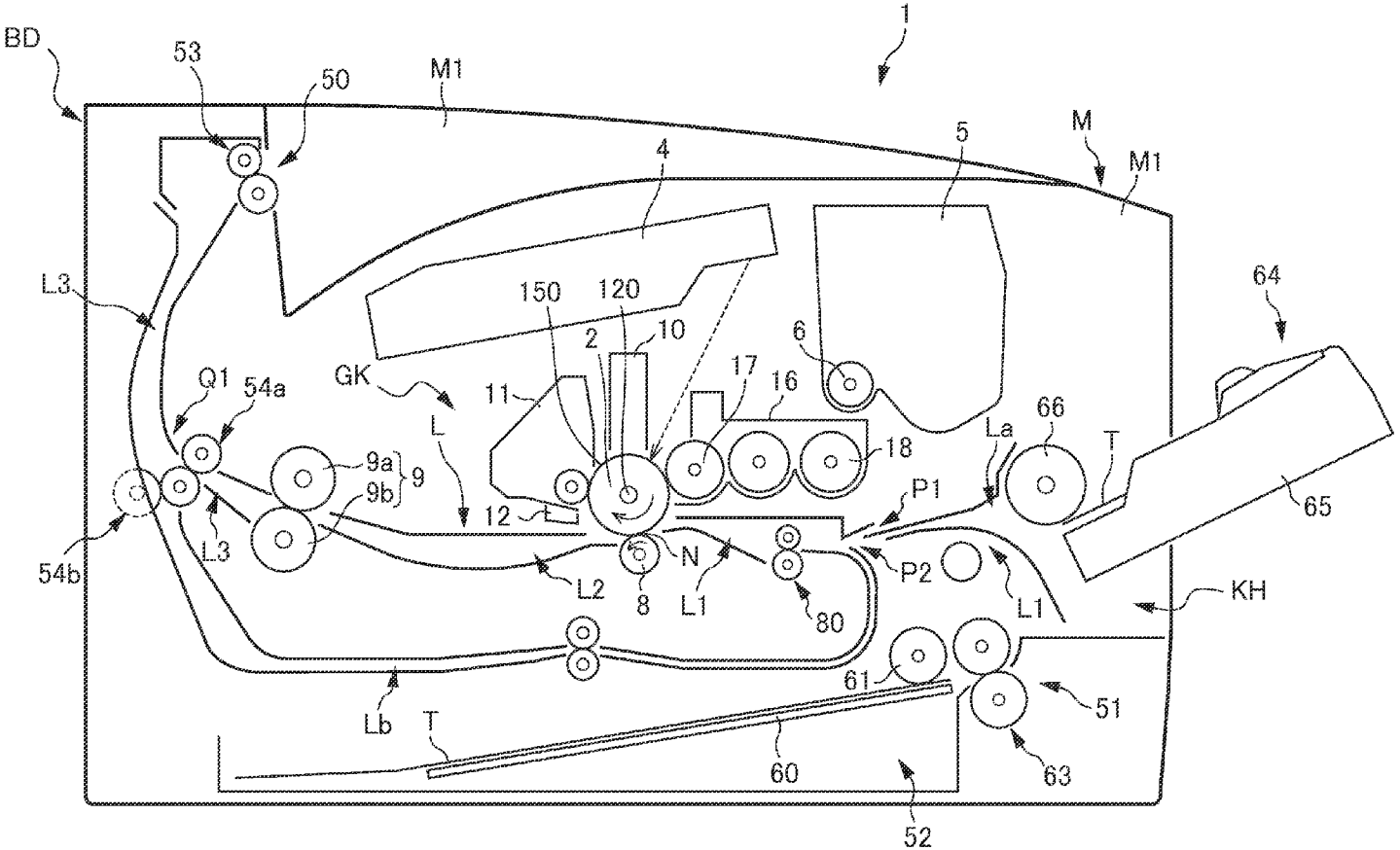
FIG. 1 is a view showing an arrangement of components of a printer 1.

An embodiment of the present invention will be hereinafter described with reference to the attached drawings. With reference to FIG. 1, a description is provided for an entire structure of a printer 1 as an image forming apparatus in a first embodiment of the present invention. FIG. 1 is a view showing an arrangement of components of the printer 1.

As shown in FIG. 1 the printer 1 as the image forming apparatus has an apparatus main unit M, an image forming unit GK, and a paper feeding/discharging portion KH. The image forming unit GK forms a predetermined toner image on a sheet of paper T as a sheet-like transfer material, based on predetermined image information. The paper feeding/discharging portion KH feeds the sheet of paper T to the image forming unit GK, and discharges the sheet of paper T on which a toner image has been formed. An external shape of the apparatus main unit M is configured with a cabinet BD as its housing.

As shown in FIG. 1, the image forming unit GK includes a photosensitive drum 2 as an image carrier (photosensitive body), a charging unit 10, a laser scanner unit 4 as an exposure unit, a developing unit 16, a toner cartridge 5, a toner supply unit 6, a drum-cleaning unit 11, a neutralization unit 12, a transfer roller 8, and a fixing part 9.

As shown in FIG. 1, the paper feeding/discharging portion KH includes a paper feed cassette 52, a manual paper feed unit 64, a conveyance path L of a sheet of paper T, a pair of resisting rollers 80, and a paper discharging unit 50.

Configurations of the image forming unit GK and the paper feeding/discharging portion KH will be hereinafter described in detail. First, the image forming unit GK is described.

Charging by the charging unit 10, exposure by the laser scanner unit 4, development by the developing unit 16, transfer by the transfer roller 8, and neutralization by the neutralization unit 12 are sequentially performed in order from upstream to downstream along a surface of the photosensitive drum 2 in the image forming unit GK.

The photosensitive drum 2 has a cylindrical photosensitive drum main body 150 and a drum penetrating shaft member 120. The drum penetrating shaft member 120 is disposed so as to penetrate the photosensitive drum main body 150 in the rotation center of the photosensitive drum main body 150. The drum penetrating shaft member 120 is a portion on one end side of a driven-shaft member in a belt driving mechanism 200 to be described later (see FIG. 2). The drum penetrating shaft member 120 is fixed to the photosensitive drum main body 150 via a connecting mechanism that is not illustrated in the drawings. An electrostatic latent image is formed on the surface of the photosensitive drum main body 150 (the surface of the photosensitive drum 2). The photosensitive drum main body 150 functions as a photosensitive body or an image carrier.

The photosensitive drum main body 150 rotates integrally with the driven-shaft member in conjunction with rotation of the driven-shaft member in the belt driving mechanism 200 to be described later. In other words, the photosensitive drum 2 is rotationally driven by the belt driving mechanism 200 to be described later. Details of the belt driving mechanism 200 that rotationally drives the photosensitive drum 2 will be described later.

The charging unit 10 is disposed to face the surface of the photosensitive drum 2. The charging unit 10 negatively or positively charges the surface of the photosensitive drum 2 uniformly (with negative or positive polarity).

The laser scanner unit 4 functions as an exposure unit, and is disposed spaced apart from the surface of the photosensitive drum 2. The laser scanner unit 4 includes a laser light source, a polygon mirror, a polygon mirror driving motor and the like, none of which are illustrated in the drawings.

The laser scanner unit 4 scans and exposes the surface of the photosensitive drum 2 based on image information that is input from an external device such as a personal computer (PC) and the like. By being scanned and exposed by the laser scanner unit 4, an electric charge in an exposed portion on the surface of the photosensitive drum 2 is removed. In this way, an electrostatic latent image may be formed on the surface of the photosensitive drum 2.

The developing unit 16 is provided in correspondence with the photosensitive drum 2, and is disposed to face the surface of the photosensitive drum 2. The developing unit 16 causes single color toner (black toner in general) to adhere to an electrostatic latent image formed on the photosensitive drum 2, thereby forming a single color toner image on the surface of the photosensitive drum 2. The developing unit 16 includes a developing roller 17 disposed to face the surface of the photosensitive drum 2, an agitation roller 18 for agitating toner, and the like.

The toner cartridge 5 is provided in correspondence with the developing unit 16, and stores toner to be supplied to the developing unit 16.

The toner supply unit 6 is provided in correspondence with the toner cartridge 5 and the developing unit 16. The toner supply unit 6 supplies the toner stored in the toner cartridge 5 to the developing unit 16. The toner supply unit 6 and the developing unit 16 are connected with each other via a toner feed passage that is not illustrated in the drawings.

The transfer roller 8 transfers a toner image, which has been developed on the surface of the photosensitive drum 2, onto a sheet of paper T. A transfer bias application unit (not shown) applies a transfer bias to the transfer roller 8. The transfer bias is a bias for transferring the toner image formed on the photosensitive drum 2 onto the sheet of paper T. The transfer roller 8 is rotatable while abutting the photosensitive drum 2.

The sheet of paper T conveyed through the conveyance path L is interposed between the photosensitive drum 2 and the transfer roller 8. The interposed sheet of paper T is pressed against the surface of the photosensitive drum 2. A transfer nip N is formed between the photosensitive drum 2 and the transfer roller 8. In the transfer nip N, the toner image developed on the photosensitive drum 2 is transferred onto the sheet of paper T.

The neutralization unit 12 is disposed to face the surface of the photosensitive drum 2. By irradiating light on the surface of the photosensitive drum 2, the neutralization unit 12 discharges electricity (neutralizes electrical charge) on the surface of the photosensitive drum 2, onto which the transfer has been performed.

The drum cleaning unit 11 is disposed to face the surface of the photosensitive drum 2. The drum cleaning unit 11 removes toner and attached matter remaining on the surface of the photosensitive drum 2, and conveys the toner and the like thus removed to a predetermined collecting mechanism for collection thereof.

By melting and pressurizing the toner that forms the toner image transferred onto the sheet of paper T, the fixing part 9 fixes the toner on the sheet of paper T. The fixing part 9 includes a heating rotor 9*a* to be heated by a heater, and a pressing rotor 9*b* to be pressed against the heating rotor 9*a*. The heating rotor 9*a* and the pressing rotor 9*b* interpose, press and convey the sheet of paper T on which the toner image has been transferred. The sheet of paper T is conveyed while interposed between the heating rotor 9*a* and the pressing rotor 9*b*. Accordingly, the toner transferred onto the sheet of paper T is melted and pressed, so that it is fixed on the sheet of paper T.

Next, the paper feeding/discharging portion KH is described.

As shown in FIG. 1, a paper cassette 52 for storing sheets of paper T is disposed in a lower portion of the apparatus main unit M. The paper cassette 52 is configured to be horizontally withdrawable from a right side (right side in FIG. 1) of the apparatus main unit M. A placing board 60 for placing the sheets of paper T is disposed in the paper cassette 52. The paper cassette 52 stores the sheets of paper T stacked on the placing board 60. A sheet of paper T placed on the placing board 60 is fed to the conveyance path L by a cassette paper feed unit 51 that is disposed at an end portion on a paper-feeding side in the paper cassette 52 (an end portion on the right in FIG. 1). The cassette paper feed unit 51 includes a double-feed prevention mechanism that is composed of a forward feed roller 61 for picking up the sheet of paper T from the placing board 60, and a pair of feed rollers 63 for feeding the sheet of paper T to the conveyance path L on a sheet by sheet basis.

A manual paper feed unit 64 is provided on the right side (right side in FIG. 1) in the apparatus main unit M. The manual paper feed unit 64 is provided to the apparatus main unit M mainly for the purpose of supplying other sheets of paper T of sizes or types different from those of the sheets of paper T that are set in the paper cassette 52. The manual paper feed unit 64 includes a manual feed tray 65 composing a part of the front face of the apparatus main unit M when the manual feed unit 64 is closed, and a paper feed roller 66. A bottom edge of the manual feed tray 65 is attached pivotable (openable and closable) to the vicinity of the paper feed roller 66. The sheets of paper T are placed on the manual feed tray 65 when it is open. The paper feed roller 66 feeds the sheet of paper T placed on the manual feed tray 65 when it is open to a manual feed conveyance path La.

A paper discharging unit 50 is provided at an upper portion of the apparatus main unit M. The paper discharging unit 50 discharges the sheet of paper T to outside the apparatus main unit M by a pair of third rollers 53. Details of the paper discharging unit 50 will be described later.

The conveyance path L for conveying the sheet of paper T includes: a first conveyance path L1 from the cassette paper feed unit 51 to the transfer nip N; a second conveyance path L2 from the transfer nip N to the fixing part 9; a third conveyance path L3 from the fixing part 9 to the paper discharging unit 50; the manual feed conveyance path La that causes a sheet of paper supplied from the manual paper feed unit 64 to join the first conveyance path L1; and a returning conveyance path Lb. The returning conveyance path Lb is where the paper conveyed from downstream to upstream through the third conveyance path L3 is reversed and then returned to the first conveyance path L1.

Moreover, a first joining portion P1 and a second joining portion P2 are provided somewhere along the first conveyance path L1. A first branching portion Q1 is provided somewhere along the third conveyance path L3. The first joining portion P1 is where the first manual feed conveyance path La joins the conveyance path L1. The second joining portion P2 is where the returning conveyance path Lb joins the first conveyance path L1. The first branching portion Q1 is where the returning conveyance path Lb branches off the third conveyance path L3. In addition, the first branching portion Q1 has a pair of first rollers 54*a* and a pair of second rollers 54*b*. The same roller concurrently serves as one of the pair of first rollers 54*a* and one of the pair of second rollers 54*b*.

A sensor (not shown) for detecting a sheet of paper T and the pair of resisting rollers 80 are disposed somewhere along the first conveyance path L1 (more specifically, between the second joining portion P2 and the transfer roller 8). The pair of resisting rollers 80 is for correcting skew (diagonal paper feed) of the sheet of paper T, and for coordinating the timing of forming a toner image in the image forming unit GK and the timing of feeding the sheet of paper T. The sensor is disposed immediately before the pair of resisting rollers 80 in a direction of conveying the sheet of paper T (upstream in the conveyance direction). The pair of resisting rollers 80 performs the aforementioned correction and timing adjustment based on information related to detection signals sent from the sensor and conveys the sheet of paper T.

The returning conveyance path Lb is a conveyance path provided for the purpose of causing another surface (unprinted surface) opposite to a surface that has already been printed to face the photosensitive drum 2 when duplex printing is performed on the sheet of paper T. With the returning conveyance path Lb, it is possible to reverse and return the sheet of paper T, which is conveyed from the first branching portion Q1 to a side closer the paper discharging unit 50 by the pair of first rollers 54*a*, to the first conveyance path L1 by the second pair of rollers 54*b*. In addition, it is possible to convey the sheet of paper T to upstream of the pair of resisting rollers 80 disposed upstream of the transfer roller 8. In the transfer nip N, a predetermined toner image is transferred onto an unprinted surface of the sheet of paper T that has been reversed through the returning conveyance path Lb.

The paper discharging unit 50 is formed at the end portion of the third conveyance path L3. The paper discharging unit 50 is disposed at the upper portion of the apparatus main unit M. The paper discharging unit 50 is open toward the right side (right side in FIG. 1, and a side closer to the manual paper feed unit 64) of the apparatus main unit M. The paper discharging unit 50 discharges the sheet of paper T conveyed through the third conveyance path L3 to outside the apparatus main unit M by the pair of third rollers 53.

A discharged paper accumulating portion M1 is formed on an opening side of the paper discharging unit 50. The discharged paper accumulating portion M1 is formed on a top face (outer face) of the apparatus main unit M. The discharged paper accumulating portion M1 is where the top face of the apparatus main unit M is formed to be recessed downward. A bottom face of the discharged paper accumulating portion M1 composes a part of the top face of the apparatus main unit M. The sheet of paper T on which a predetermined toner image has been formed and that has been discharged from the paper discharging unit 50 is stacked and accumulated on the discharged paper accumulating portion M1. It should be noted that a sensor for detecting a sheet of paper is disposed in a predetermined position of each conveyance path.

Next, operations of the printer 1 of the first embodiment will be briefly described with reference to FIG. 1. First, a case of performing single-side printing on a sheet of paper T stored in the paper cassette 52 is described.

The sheet of paper T stored in the paper cassette 52 is fed to the first conveyance path L1 by the forward feed roller 61 and the pair of feed rollers 63. In addition, the sheet of paper T is subsequently conveyed through the first joining portion P1 and the first conveyance path L1 to the pair of resisting rollers 80. The pair of resisting rollers 80 performs skew correction of the sheet of paper T and adjustment of timing with a toner image.

The sheet of paper T discharged from the pair of resisting rollers 80 is introduced between the photosensitive drum 2 and the transfer roller 8 (i.e. in the transfer nip N) through the first conveyance path L1. In addition, a toner image is transferred onto the sheet of paper T between the photosensitive drum 2 and the transfer roller 8. Subsequently, the sheet of paper T is discharged from between the photosensitive drum 2 and the transfer roller 8, and is introduced to a fixing nip between the heating rotor 9*a* and the pressing rotor 9*b* in the fixing part 9 through the second conveyance path L2. In the fixing nip, the toner is melted and fixed on the sheet of paper T.

Subsequently, the sheet of paper T is conveyed through the third conveyance path L3 to the paper discharging unit 50 by the pair of first rollers 54*a*, and is discharged from the paper discharging unit 50 to the discharged-paper accumulating portion M1 by the pair of third rollers 53. In this way, the single-side printing of the sheet of paper T stored in the paper cassette 52 is completed.

In a case of performing single-side printing on a sheet of paper T placed on the manual feed tray 65, the sheet of paper T placed on the manual feed tray 65 is fed to the manual feed conveyance path La by the paper feed roller 66, and is subsequently conveyed through the first joining portion P1 and the first conveyance path L1 to the pair of resisting rollers 80. Subsequent operations are similar to the aforementioned operations of the single-side printing of the sheet of paper T stored in the paper cassette 52, and thus a description thereof is omitted.

Next, operations of the printer 1 in a case of performing duplex printing will be described.

As described above, in a case of the single-side printing, the printing operations are completed when the sheet of paper T on which single-side printing has been performed is discharged from the paper discharging unit 50 to the discharged-paper accumulating portion M1. In contrast, in a case of performing duplex printing, the sheet of paper T on which single-side printing has been performed is reversed through the returning conveyance path Lb, and then conveyed again to the pair of resisting rollers 80. In this manner, duplex printing is performed on the sheet of paper T.

More specifically, the operations are similar to the operations of single-side printing as described above, until the sheet of paper T on which single-side printing has been performed is discharged from the paper discharging unit 50 by the pair of third rollers 53. On the other hand, in a case of duplex printing, the rotation of the pair of third rollers 53 is stopped, and the pair of third rollers 53 is rotated in an opposite direction, while the sheet of paper T on which single-side printing has been performed is held by the pair of third rollers 53. When the pair of third rollers 53 is rotated in the opposite direction, the sheet of paper T held by the pair of third rollers 53 is conveyed to the opposite direction through the third conveyance path L3 (in a direction from the paper discharging unit 50 to the first branching portion Q1).

As described above, when the sheet of paper T is conveyed through the third conveyance path L3 in the opposite direction, the sheet of paper T is introduced between the pair of second rollers 54*b* (instead of the pair of first rollers 54*a*). The sheet of paper T then joins the first conveyance path L1 through the returning conveyance path Lb and the second joining portion P2. Here, the sheet of paper T has already been reversed from the single-side printing.

Furthermore, the correction or the adjustment is performed on the sheet of paper T by the pair of resisting rollers 80. The sheet of paper T is introduced between the photosensitive drum 2 and the transfer roller 8 through the first conveyance path L1. As a result of the sheet of paper T passing through the returning conveyance path Lb, an unprinted surface of the sheet of paper T faces the photosensitive drum 2. Accordingly, a toner image is transferred onto the unprinted surface, and as a result, duplex printing is completed.

Figure 2:
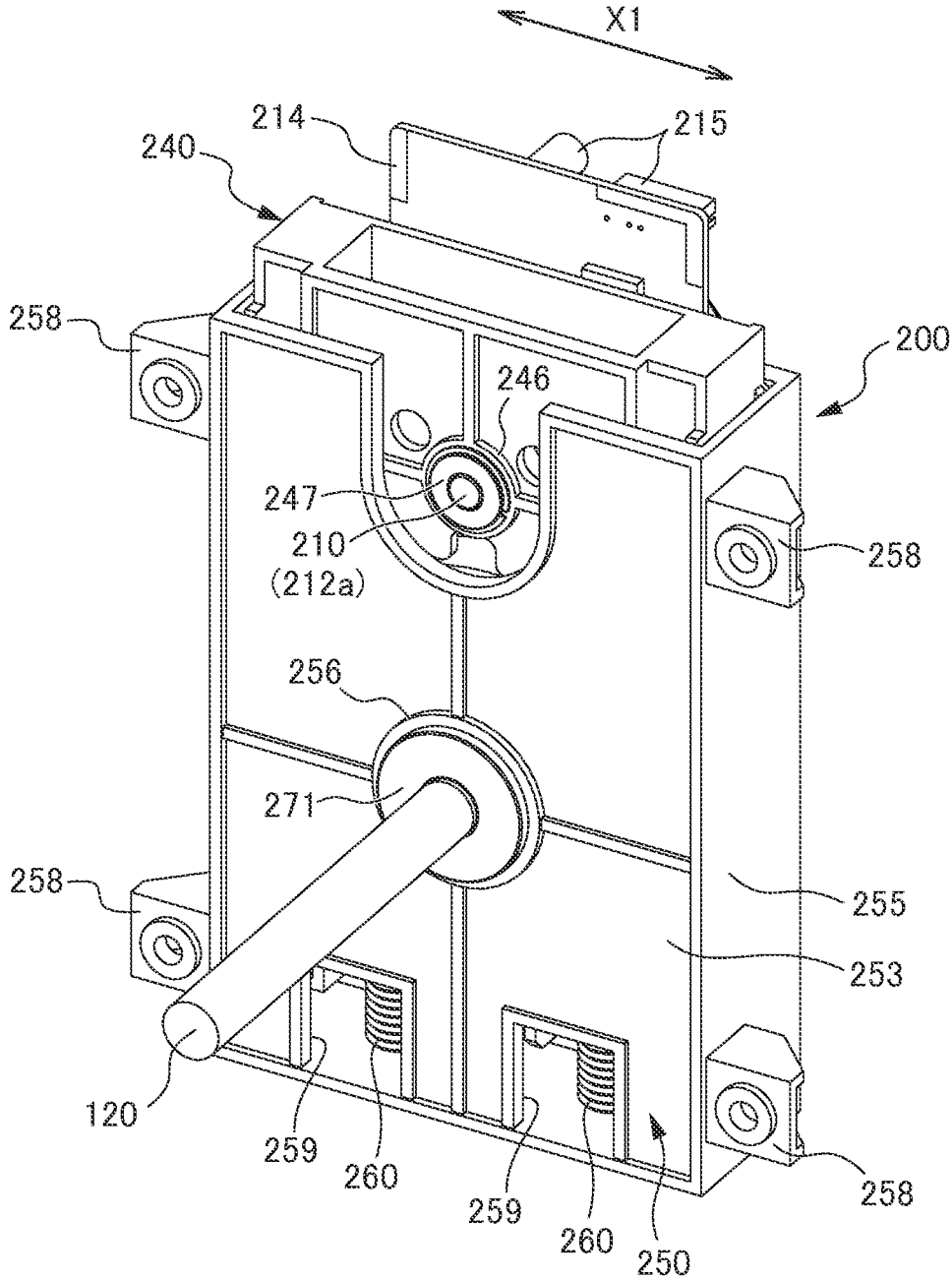
FIG. 2 is a perspective view showing a belt driving mechanism 200 as a first embodiment of the present invention, seen from a front face side.
Figure 3:
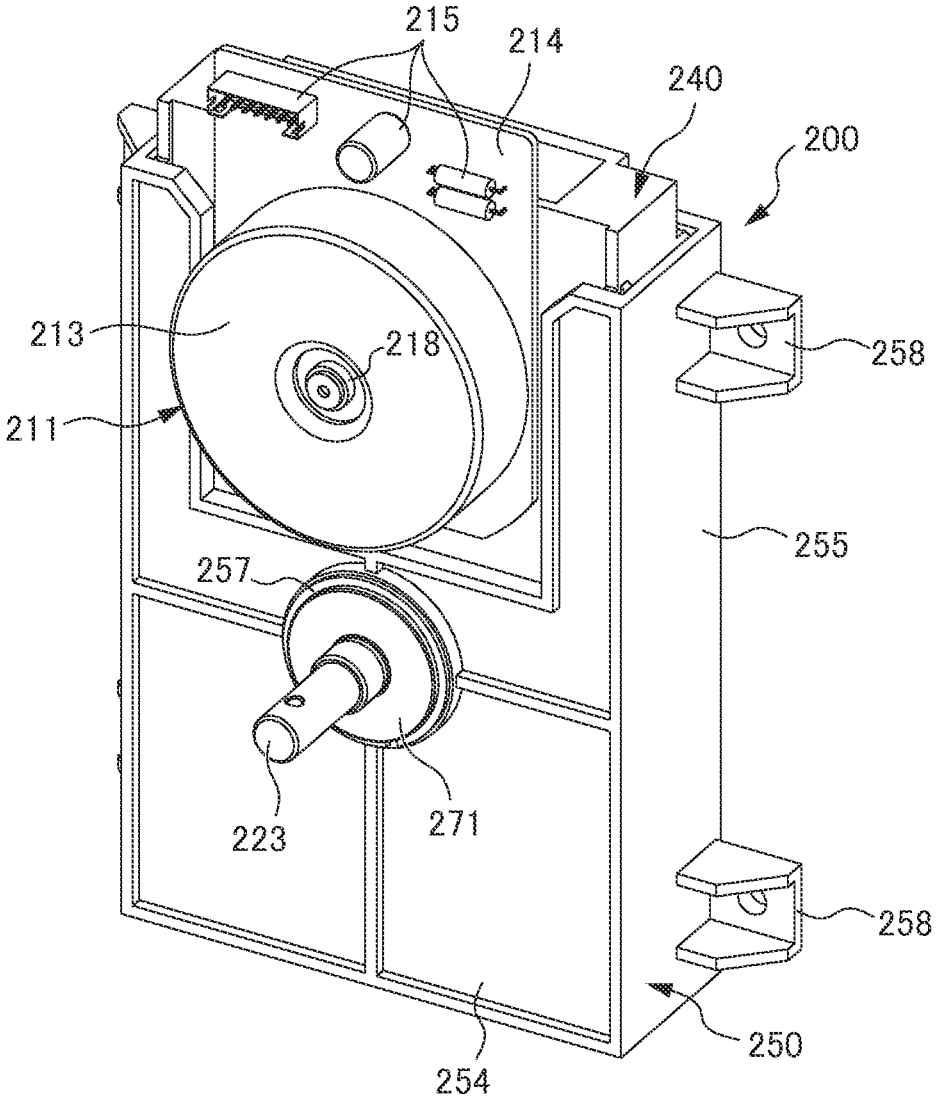
FIG. 3 is a perspective view showing the belt driving mechanism 200 illustrated in FIG. 2, seen from a rear face side.
Figure 4:
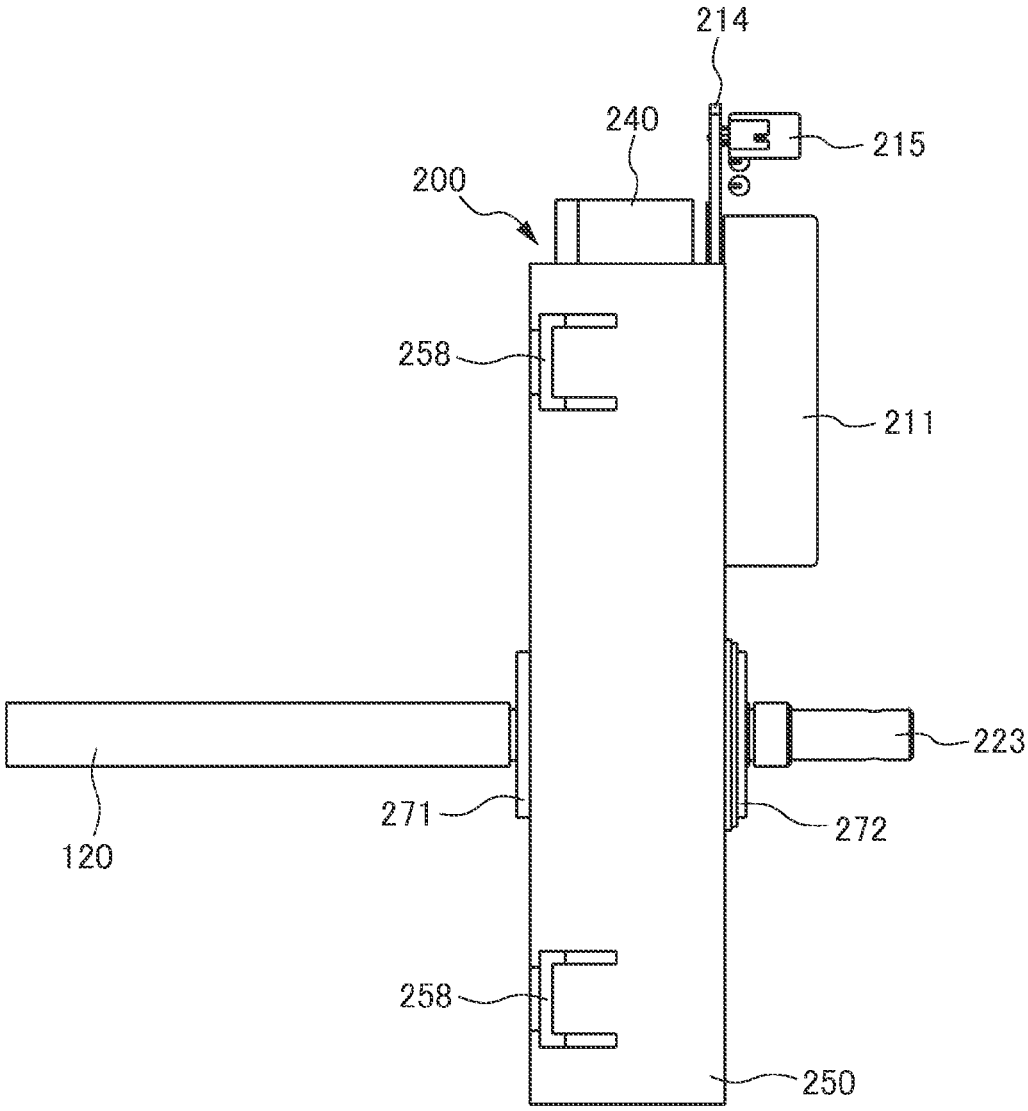
FIG. 4 is a side view showing the belt driving mechanism 200 illustrated in FIG. 2.
Figure 5:
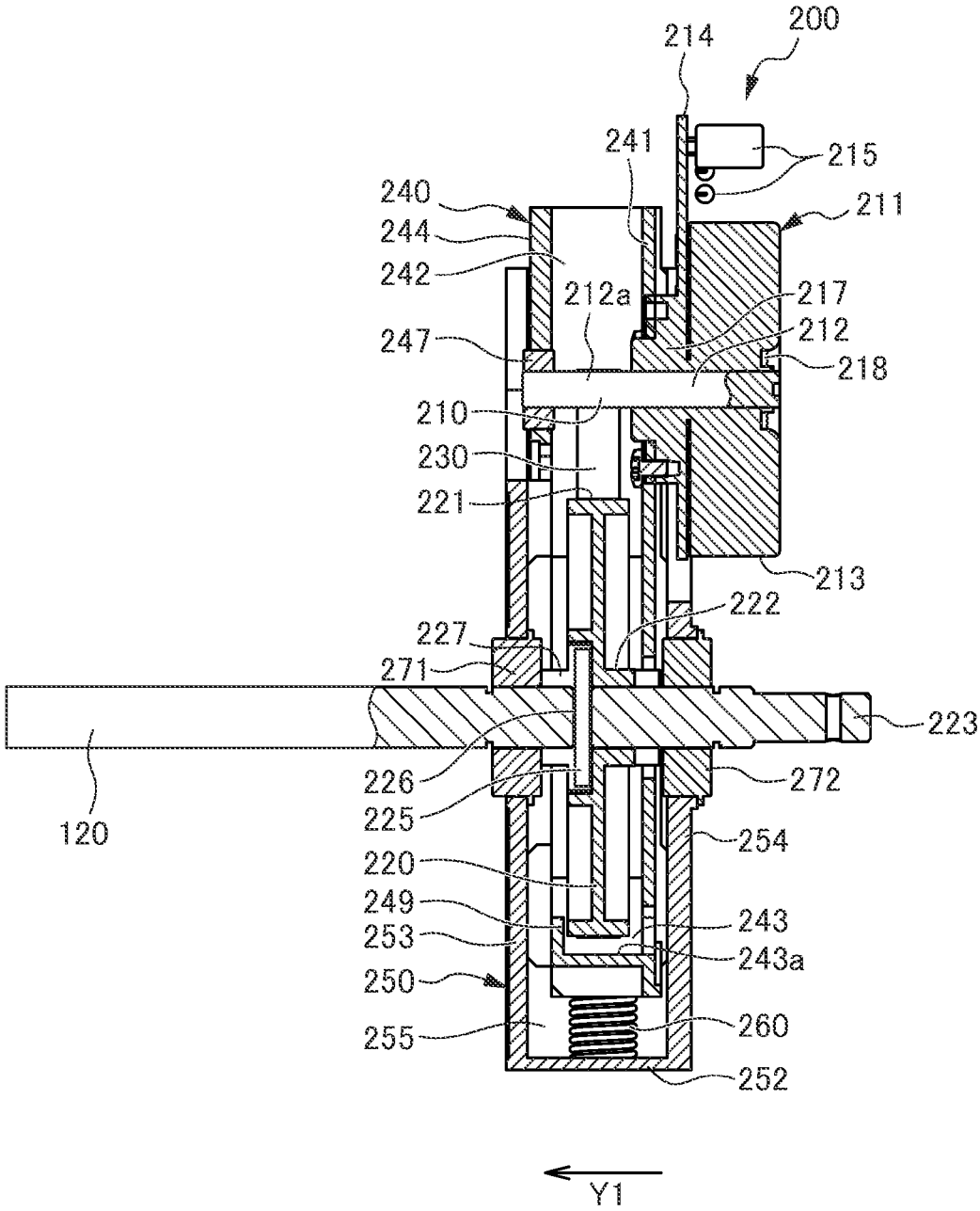
FIG. 5 is a vertical cross-sectional view showing the belt driving mechanism 200 illustrated in FIG. 2, cut along a vertical plane passing through a center of a driven-shaft member 120.
Figure 6:
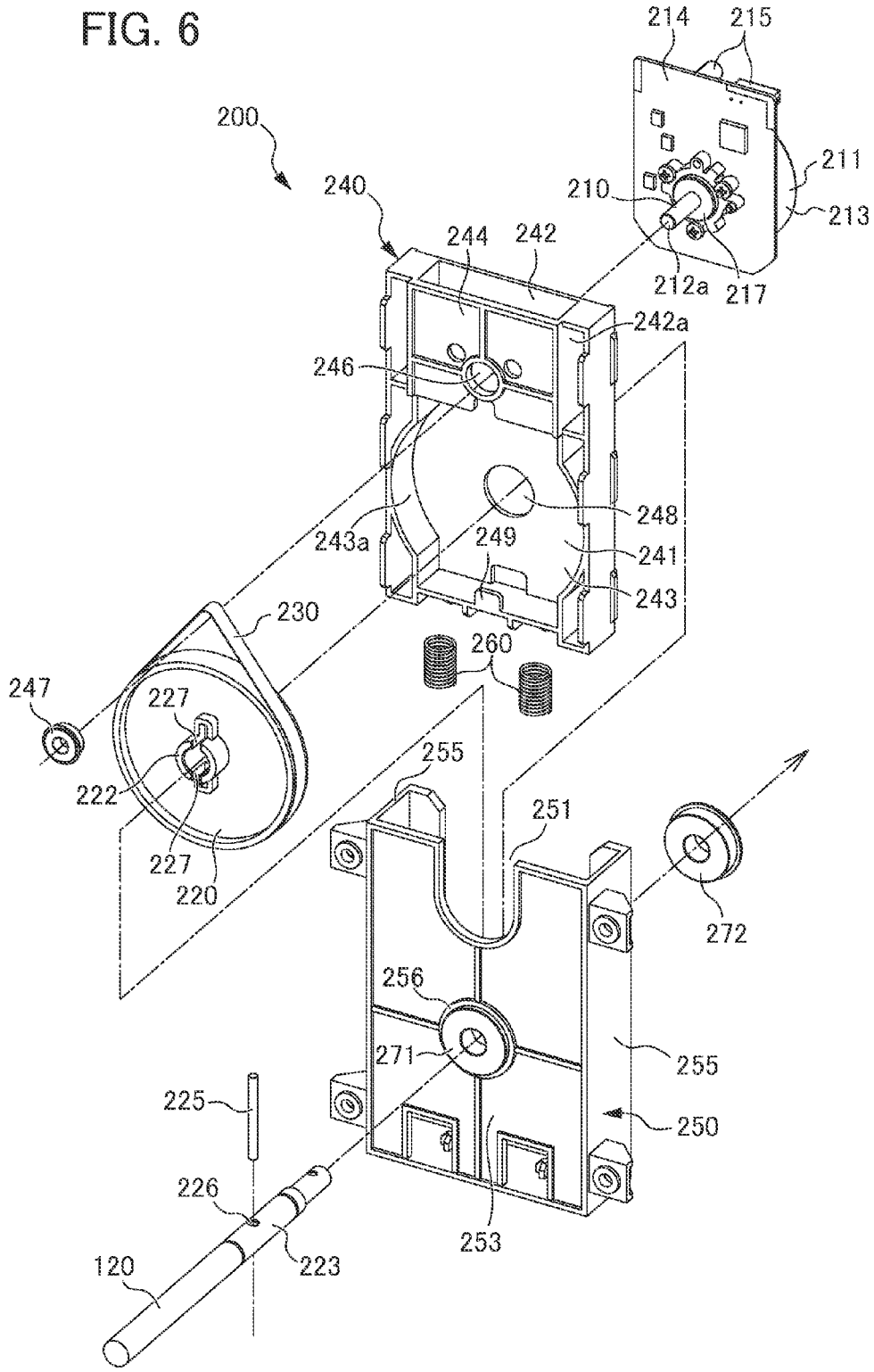
FIG. 6 is an exploded perspective view showing the belt driving mechanism 200 illustrated in FIG. 2.
Figure 7:
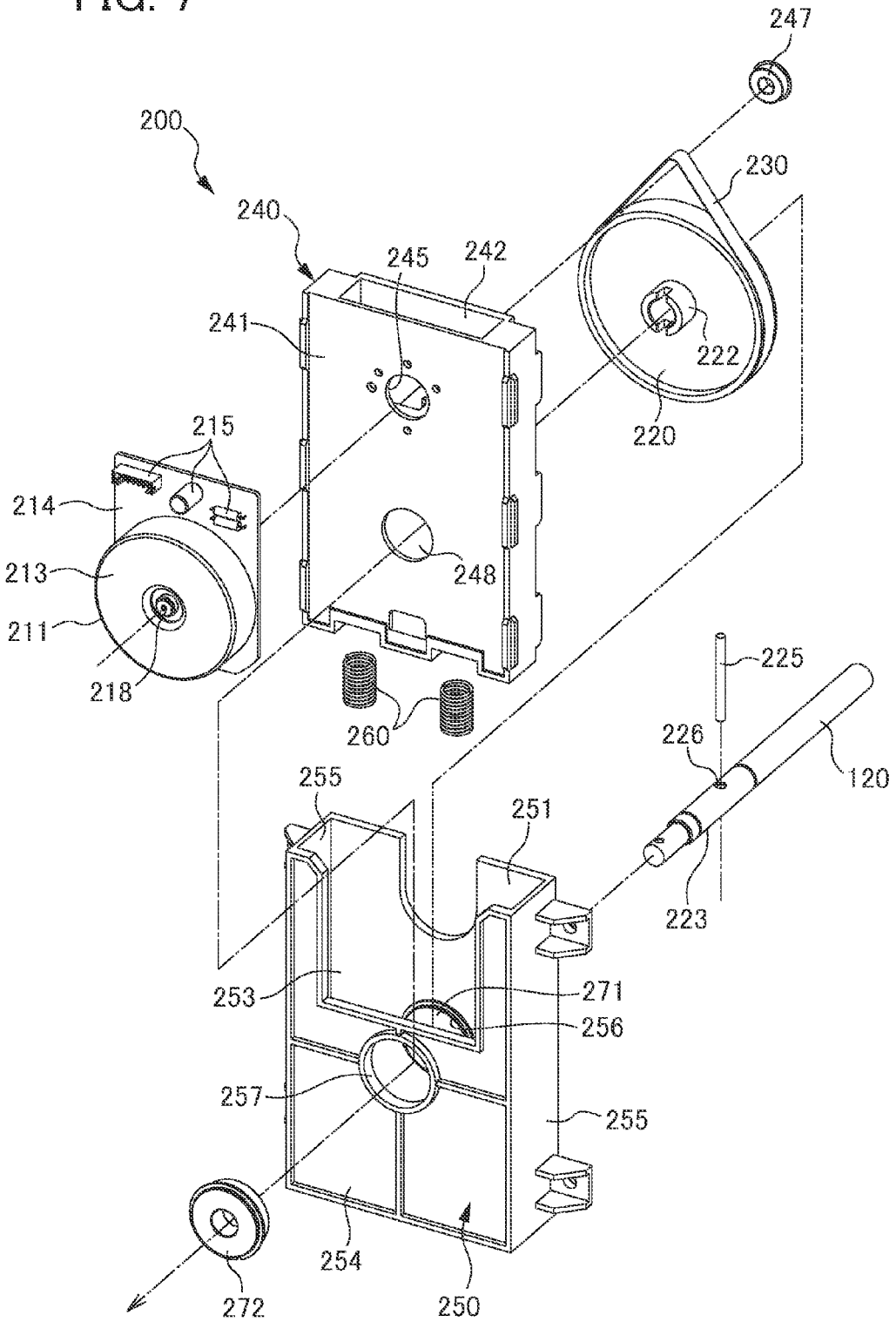
FIG. 7 is an exploded perspective view showing each part illustrated in FIG. 6, seen from the rear face side.
Figure 8:
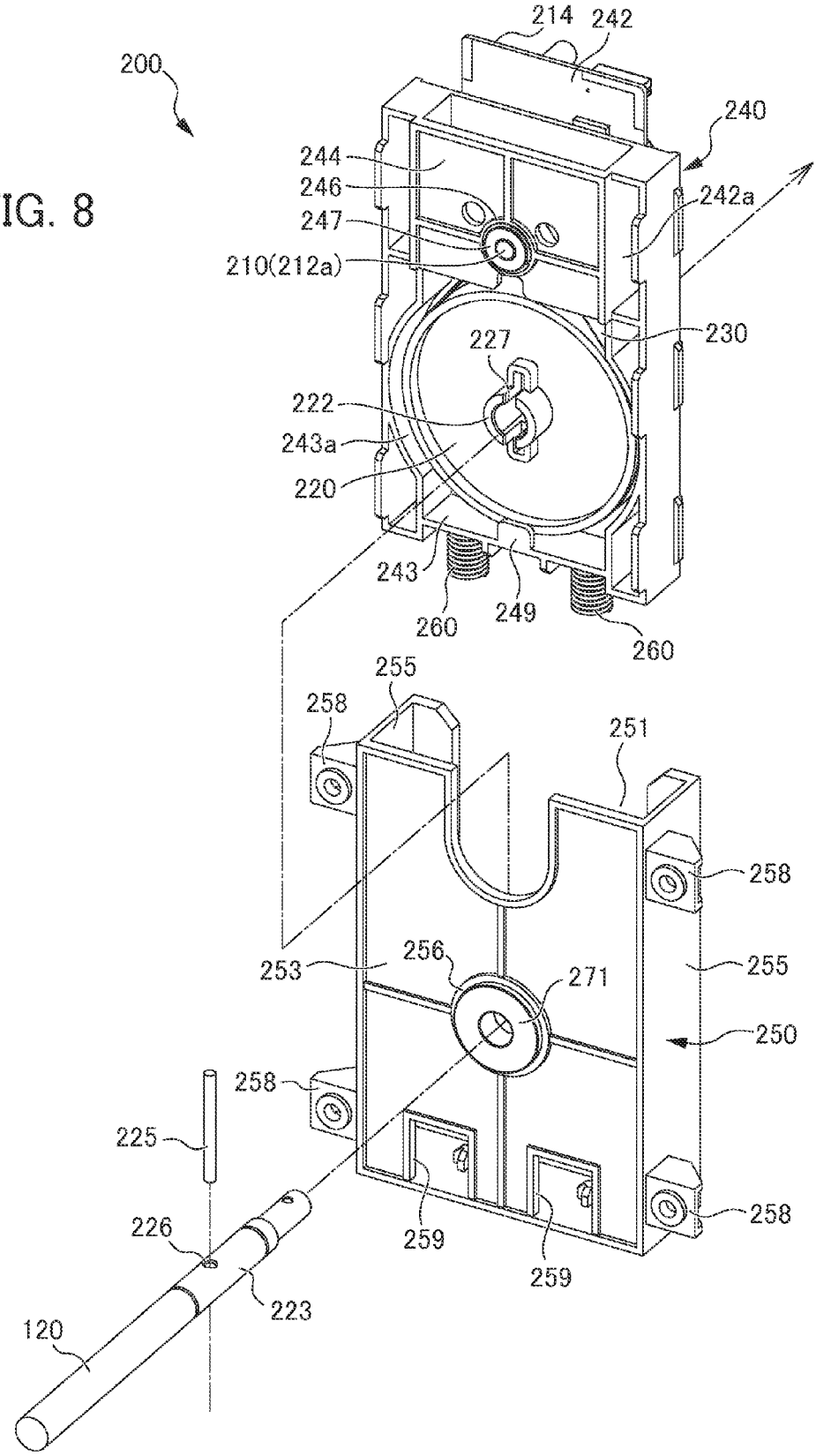
FIG. 8 is a perspective view showing a first holding member assembly that is configured by fixing a motor, a driving pulley, a driven pulley 220 and the like to a first holding member 240 illustrated in FIG. 6, and the first holding member assembly is seen from the front face side in a state before being fixed to a second holding member 250.
Figure 9:
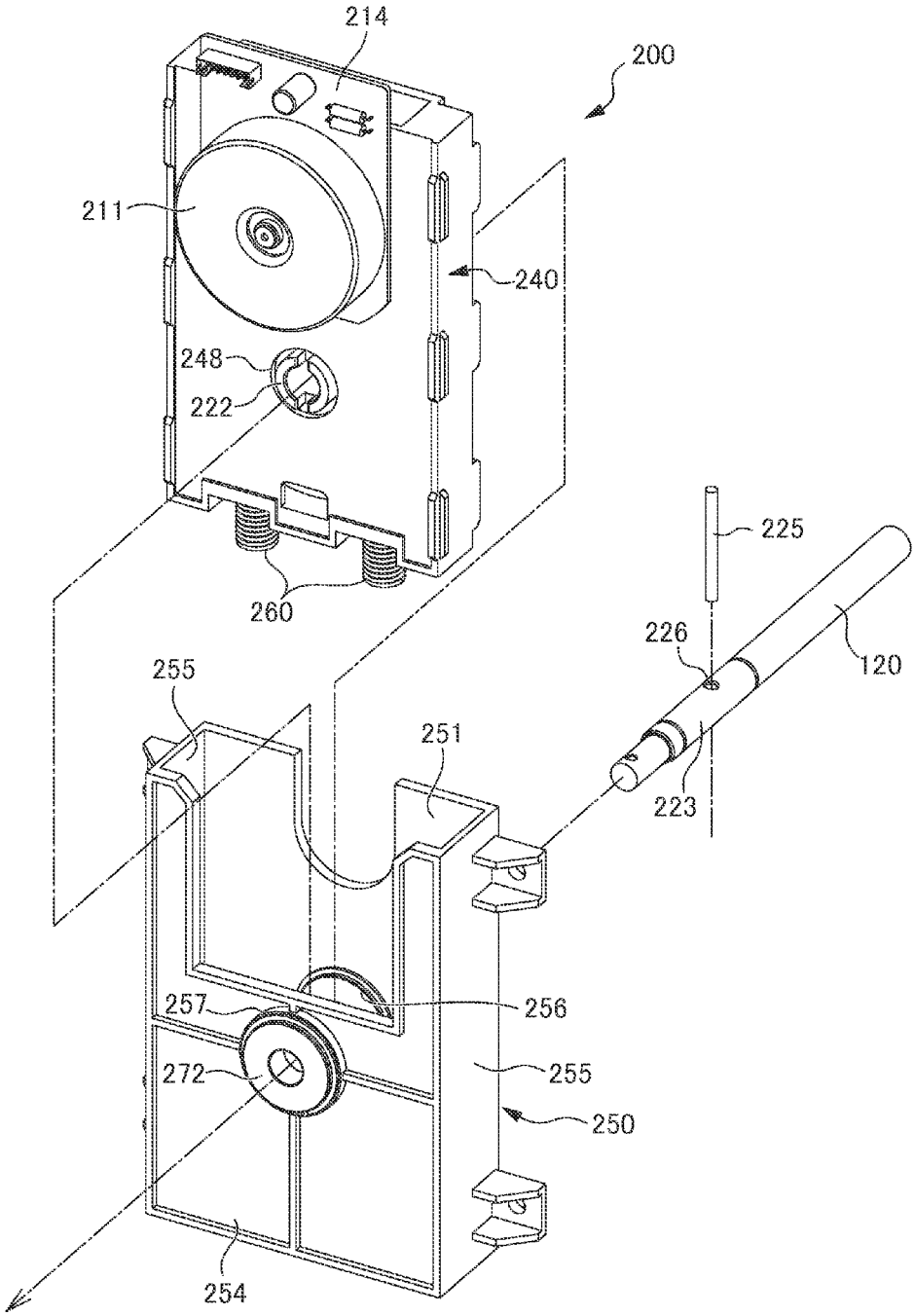
FIG. 9 is a perspective view showing each part illustrated in FIG. 8, seen from the rear face side.

Next, a description is provided for the belt driving mechanism 200 that rotationally drives the photosensitive drum 2. FIG. 2 is a perspective view showing the belt driving mechanism 200 as the first embodiment of the present invention, seen from a front face side. FIG. 3 is a perspective view showing the belt driving mechanism 200 illustrated in FIG. 2, seen from the rear face side. FIG. 4 is a side view showing the belt driving mechanism 200 illustrated in FIG. 2. FIG. 5 is a vertical cross-sectional view showing the belt driving mechanism 200 illustrated in FIG. 2, cut along a vertical plane passing through the center of a driven-shaft member 120. FIG. 6 is an exploded perspective view showing the belt driving mechanism 200 illustrated in FIG. 2. FIG. 7 is an exploded perspective view showing each part illustrated in FIG. 6, seen from the rear face side. FIG. 8 is a perspective view showing a first holding member assembly that is configured by fixing a motor, a driving pulley, a driven pulley 220 and the like to a first holding member 240 illustrated in FIG. 6, and the first holding member assembly is seen from the front face side in a state before being fixed to a second holding member 250. FIG. 9 is a perspective view showing each part illustrated in FIG. 8, seen from the rear face side.

As shown in FIGS. 2 to 9, the belt driving mechanism 200 of the first embodiment includes a driving pulley 210, the driven pulley 220, a transmission belt 230, the first holding member 240, the second holding member 250, and biasing members 260.

The driving pulley 210 is composed of an output shaft member 212 in a motor 211 as a rotational driving unit that outputs a rotational driving force. The output shaft member 212 is an output shaft of the motor 211. The driving pulley 210 is formed of an outer periphery of an intermediate portion in the longitudinal direction of a shank 212*a* of the output shaft member 212 protruding from a motor case 213.

The driven pulley 220 is a pulley connected to the drum penetrating shaft member 120. The diameter of the transmission belt 230 around which the transmission belt 230 is wound is set larger than the diameter of the driving pulley 210, such that a rotational driving force transmitted from the driving pulley 210 via the transmission belt 230 is transmitted to the drum penetrating shaft member 120 at decreased speed. The driven pulley 220 has a peripheral face 221 with a crowning shape, as an outer periphery around which the transmission belt 230 is wound.

As shown in FIGS. 5 and 6, the driven pulley 220 has an axis fitting cylinder 222 in its center. The driven-shaft member 223 is fitted within, and is connected to, the axis fitting cylinder 222.

One end side of the driven-shaft member 223 composes the drum penetrating shaft member 120. The driven-shaft member 223 is fitted within, and is connected to, the axis fitting cylinder 222. As shown in FIGS. 6 and 7, the driven-shaft member 223 has a pin fixing hole 226 into which a rotation-stopping pin member 225 is press-fitted. A split pin is generally used as the pin member 225. The pin fixing hole 226 is provided so as to penetrate through the diameter direction of the driven-shaft member 223. The axial length of the pin member 225 is set larger than the diameter of the driven-shaft member 223. As shown in FIG. 5, the pin member 225 is press-fitted into the pin fixing hole 226 such that both ends of the pin member 225 protrude from the outer circumference of the driven-shaft member 223.

As shown in FIGS. 6 and 8, the axis fitting cylinder 222 of the driven pulley 220 described above has a slot 227. The pin member 225 protruding from the driven-shaft member 223 is squeezed into the slot 227. As shown in FIG. 5, by squeezing the pin member 225, which protrudes from the driven-shaft member 223, into the slot 227, the driven-shaft member 223 is connected to the rotation center of the driven pulley 220 so as not to be capable of relatively rotating. In other words, the driven pulley 220 of the first embodiment includes the driven-shaft member 223 in its rotation center.

The transmission belt 230 is a metallic loop belt extended over the driving pulley 210 and the driven pulley 220. The metallic transmission belt 230 consists of, for example, an endless stainless belt. The material of the transmission belt 230 is not limited to metal, and may be, for example, carbon, ceramic or resin.

The first holding member 240 is a housing that bearing-supports and holds the driving pulley 210. As shown in FIGS. 5 and 6, the first holding member 240 is an elongated housing that is substantially shaped like a box. The first holding member 240 includes: a substantially tabular rear wall 241; a first accommodating portion 242 that accommodates the driving pulley 210; and a second accommodating portion 243 that accommodates the driven pulley 220. The first accommodating portion 242 is formed in an area of an upper half part on the front side of the rear wall 241. The second accommodating portion 243 is formed in an area of a lower half part on the front side of the rear wall 241.

The first accommodating portion 242 is space interposed between the rear wall 241 and the front wall 244. The front wall 244 is disposed in parallel with the rear wall 241 so as to face the front side (the left side in FIG. 5) of the rear wall 241. The front wall 244 is integrated with the rear wall 241 via side walls 242*a* at both ends of a width direction thereof (a direction X1 indicated by a directional arrow in FIG. 2).

As shown in FIG. 7, an opening 245 is formed to penetrate an area forming the first accommodating portion 242 in the rear wall 241. The opening 245 is an opening for inserting the driving pulley 210 through the first accommodating portion 242, the driving pulley 210 being formed integrally with the shank 212*a* of the output shaft member 212 of the motor 211. In addition, as shown in FIG. 6, an opening 246 is formed to penetrate the front wall 244. The opening 246 is an opening for rotatably supporting an end portion of the driving pulley 210 that is inserted through the first accommodating portion 242, the end portion being opposite to the motor 211.

As shown in FIG. 5, the motor 211 is attached on a rear face (a face opposite to the first accommodating portion 242) of the rear wall 241, such that the shank 212*a* is inserted through the first accommodating portion 242.

A control board 214 is fixed on the front face (left end face in FIG. 5) of the motor case 213 of the motor 211. Various circuit components 215 for controlling operations of the motor 211, and a first bearing member 217 are fixed on the control board 214. The first bearing member 217 is a bearing that rotatably supports the end portion of the shank 212*a*, the end portion being on the motor case 213 side. As shown in FIG. 5, the motor 211 has a second bearing member 218 on a rear end face (right end face in FIG. 5) side of the motor case 213. The second bearing member 218 is a bearing that rotatably supports an end portion of the output shaft member 212 that is inserted through the inside of the motor case 213. In other words, the motor 211 rotatably supports the output shaft member 212 by way of two bearings including the first bearing member 217 and the second bearing member 218.

As shown in FIG. 5, the motor 211 is fixed on a rear face of the rear wall 241 in an arrangement in which the control board 214 faces the rear face of the rear wall 241. When the motor 211 is fixed to the rear wall 241, the first bearing member 217 is fitted into, and fixed to, the opening 245 of the rear wall 241.

A third bearing member 247, which is formed separately from the front wall 244, is fixed into the opening 246 formed in the front wall 244. The third bearing member 247 is a bearing for rotatably supporting an end portion of the shank 212*a* that is inserted through the first accommodating portion 242, the end portion being opposite to the motor case 213. In other words, the shank 212*a* that forms the driving pulley 210 is inserted through the first accommodating portion 242. As shown in FIG. 5, both ends of the shank 212*a* interposing the driving pulley 210 are rotatably supported by two bearings including the third bearing member 247 and the first bearing member 217.

In other words, in the output shaft member 212 formed integrally with the driving pulley 210, an end portion thereof, which is positioned on the front wall 244 side relative to the transmission belt 230 extended over the driving pulley 210, is rotatably supported by the third bearing member 247. Furthermore, in the output shaft member 212, another end portion thereof, which extends to the side opposite to the front wall 244 relative to the transmission belt 230, is supported by two bearings including the first bearing member 217 and the second bearing member 218. In other words, in the first embodiment, the output shaft member 212 of the motor 211 is bearing-supported at a plurality of positions so as to interpose the transmission belt 230 extended over the driving pulley 210 in the axial direction of the output shaft member 212.

As shown in FIG. 6, the second accommodating portion 243 is formed in the area of the lower half part of the rear wall 241 of the first holding member 240, and is space in which the front face side facing the rear wall 241 is open. The second accommodating portion 243 is a portion that accommodates the driven pulley 220. The dimension of a circumferential wall surface 243*a* that surrounds an outer circumference of the second accommodating portion 243 is set so as not to touch an outer circumference of the driven pulley 220 and the transmission belt 230 extended over the driven pulley 220.

The assembly of the driven pulley 220 to the second accommodating portion 243 is performed from an open portion of the front face side. As shown in FIG. 6, an opening 248 is formed to penetrate the area corresponding to the second accommodating portion 243 of the rear wall 241, and the driven-shaft member 223 can be inserted through the opening 248. The opening 248 is formed such that a center thereof substantially coincides with a center of the axis fitting cylinder 222 of the driven pulley 220 accommodated in the second accommodating portion 243.

Moreover, in the first embodiment, the first holding member 240 has a pulley position restriction protrusion 249. The pulley position restriction protrusion 249 is provided to protrude from a bottom edge of the circumferential wall surface 243*a* of the second accommodating portion 243, the bottom edge being opposite to the rear wall 241, so as to hang over an outer periphery of the driven pulley 220 accommodated in the second accommodating portion 243. The pulley position restriction protrusion 249 restricts the driven pulley 220 disposed in the second accommodating portion 243 from moving in a direction toward an open side of the second accommodating portion 243 (a direction indicated by a directional arrow Y1 in FIG. 5).

As shown in FIG. 8, in a state in which the driven pulley 220 is disposed in the second accommodating portion 243 of the first holding member 240, and the first holding member 240 is not combined with the second holding member 250 (to be described later), the pulley position restriction protrusion 249 functions as a falling-off suppression structure that suppresses the driven pulley 220 from falling off the first holding member 240. In other words, the first holding member 240 in the first embodiment has the falling-off suppression structure that suppress the driven pulley 220 from falling off the first holding member 240, in a state of being not combined with the second holding member 250.

In addition, in the first embodiment, the pulley position restriction protrusion 249 hangs over the transmission belt 230 extended over the outer circumference of the driven pulley 220. The pulley position restriction protrusion 249 also functions as a movement restriction part that restricts the transmission belt 230 from moving in the width direction of the driven pulley 220 in a case in which the transmission belt 230 meanders. In other words, in the first embodiment, the first holding member 240 has the movement restriction part that restricts the transmission belt 230 from moving in the width direction of the driven pulley 220 in a case in which the transmission belt 230 meanders.

As shown in FIGS. 5 to 7, the first holding member 240 described above is composed of an integrally molded article made of resin, in which portions other than the first bearing member 217 and the third bearing member 247 are integrally formed.

The second holding member 250 is a housing, which bearing-supports and holds the driven pulley 220, and which is combined with the first holding member 240. As shown in FIGS. 5 to 7, the second holding member 250 is an elongated housing, which is substantially shaped like a box, and which has an accommodating portion 251 whose top side is open.

The accommodating portion 251 is space that accommodates substantially the entirety of the first holding member 240. As shown in FIGS. 5 to 7, the second holding member 250 is a bottomed rectangular cylinder whose top is open, and includes: a bottom wall 252 facing the bottom face of the first holding member 240; a front wall 253 facing the front face (left face in FIG. 5) of the first holding member 240; a rear wall 254 facing the rear face (right face in FIG. 5) of the first holding member 240; and side walls 255 respectively facing the side faces of the first holding member 240. The accommodating portion 251 with an open top is formed with the bottom wall 252, the front wall 253, the rear wall 254 and the side walls 255.

As shown in FIG. 7, an opening 256 and an opening 257 for rotatably supporting the driven-shaft member 223 are formed so as to respectively penetrate the front wall 253 and the rear wall 254 of the second holding member 250.

The shaft center of each of the opening 256 and the opening 257 coincides with the insertion direction of the driven-shaft member 223. As shown in FIG. 6, a fourth bearing member 271 that is separate from the second holding member 250 is releasably attached to the opening 256. Similarly, as shown in FIGS. 7 and 9, a fifth bearing member 272 that is separate from the second holding member 250 is releasably attached to the opening 257.

As shown in FIG. 5, the driven-shaft member 223 connected to the rotation center of the driven pulley 220 is bearing-supported at a plurality of positions including: the fourth bearing member 271 fixed to the front wall 253 of the second holding member 250; and the fifth bearing member 272 fixed to the rear wall 254. In other words, in the first embodiment, the driven-shaft member 223 is bearing-supported at the plurality of positions so as to interpose the driven pulley 220 in the axial direction of the driven-shaft member 223.

As shown in FIGS. 2 and 3, attachment parts 258 for fastening to the cabinet BD of the printer 1 are provided to the side walls 255 of the second holding member 250. Furthermore, as shown in FIG. 2, the lower portion of the front wall 253 of the second holding member 250 is provided with openings 259, through which an attachment state of the biasing members 260 (to be described later) is visible.

As shown in FIG. 5, the biasing members 260 are compression coiled springs that are attached, in a compressed state, between the bottom face of the first holding member 240 and the bottom wall 252 of the second holding member 250. As shown in FIG. 5, in a state in which the first holding member 240 and the second holding member 250 are combined, the biasing members 260 bias the first holding member 240 and the second holding member 250 to be separated. More specifically, in FIG. 5, the biasing members 260 bias the first holding member 240 accommodated in the accommodating portion 251 toward the top open side of the accommodating portion 251. Due to this biasing force, the output shaft member 212 that is integral with the driving pulley 210 is biased toward a direction to be separated from the driven-shaft member 223. As a result, looseness of the transmission belt 230 extended over the driving pulley 210 and the driven pulley 220 is removed, and tensile force is imparted thereto.

In the second holding member 250, portions other than the fourth bearing member 271 and the fifth bearing member 272 is an integrally molded article made of resin.

The belt driving mechanism 200 of the first embodiment is assembled through the following procedure. First, the driven pulley 220 and the transmission belt 230 are disposed in the second accommodating portion 243 of the first holding member 240 shown in FIGS. 6 and 8. Furthermore, the motor 211 is fixed to the first holding member 240, and the third bearing member 247 rotatably supports the shank 212*a* that is inserted through the opening 246 of the first holding member 240. As a result, as shown in FIGS. 8 and 9, a partial assembly is obtained, in which the motor 211, the driven pulley 220 and the transmission belt 230 are fixed to the first holding member 240. Subsequently, the first holding member 240 as the partial assembly is inserted into the accommodating portion 251 of the second holding member 250. Thereafter, the fourth bearing member 271 and the fifth bearing member 272 of the second holding member 250 pivotally support the driven-shaft member 223. As a result, the belt driving mechanism 200 is assembled into an assembled state shown in FIG. 5.

According to the first embodiment, for example, the following effects are achieved.

The belt driving mechanism 200 of the first embodiment includes: the driving pulley 210; the driven pulley 220; the looped transmission belt 230 extended over the driving pulley 210 and the driven pulley 220; the first holding member 240 that bearing-supports and holds the driving pulley 210; the second holding member 250 that bearing-supports and holds the driven pulley 220, and is combined with the first holding member 240; and the biasing members 260 that bias the first holding member 240 and the second holding member 250 to be separated, in a state in which the first holding member 240 and the second holding member 250 are combined.

Therefore, since the biasing members 260 bias the first holding member 240 and the second holding member 250 toward a direction to be separated, the biasing force toward the direction to be separated also acts between the pulleys 210 and 220 that are respectively held by the holding members 240 and 250. In addition, due to the biasing force acting between the pulleys 210 and 220, the tensile force for removing looseness acts on the transmission belt 230 extended between the pulleys 210 and 220. Therefore, it is possible to obtain a state in which the looseness is removed from the looped transmission belt 230 that is now stably extended over the driving pulley 210 and the driven pulley 220. Therefore, according to the belt driving mechanism 200 of the first embodiment, the pulleys 210 and 220 can be stably rotated.

Moreover, in the belt driving mechanism 200 of the first embodiment, the second holding member 250 has the accommodating portion 251 that can accommodate the first holding member 240.

Therefore, by configuring the accommodating portion 251, which is provided to the second holding member 250, to interpose the first holding member 240 so as not to topple, by way of the accommodating portion 251, it is possible to prevent toppling between the holding members 240 and 250. By preventing the toppling between the holding members 240 and 250, the toppling between the pulleys 210 and 220 is also prevented, the mutual alignment of the pulleys 210 and 220 can also be maintained to be accurate, and the meandering of the belt can be suppressed.

In addition, in the belt driving mechanism 200 of the first embodiment, the first holding member 240 is composed of an integrally molded article made of resin, at least in portions other than the bearings. Therefore, when assembling the driving pulley 210, assembly errors of a plurality of parts can be avoided from accumulating, and the attachment accuracy of the driving pulley 210 can be enhanced.

Furthermore, in the belt driving mechanism 200 of the first embodiment, the first holding member 240 has the pulley position restriction protrusion 249 that is a movement restriction part that restricts the transmission belt 230 from moving in the width direction of the driven pulley 220 in a case in which the transmission belt 230 meanders.

Therefore, when the driven pulley 220 is going to move in the width direction in conjunction with the meandering of the transmission belt 230, the movement restriction part provided to the first holding member 240 functions as an abutment part abutted by the side edge face of the driven pulley 220, and restricts movement of the driven pulley 220 in the width direction. Therefore, it is possible to suppress the meandering of the transmission belt 230 from increasing, to maintain a state in which the transmission belt 230 is stably extended over the pulley, and to stably rotate the pulley.

Moreover, in the belt driving mechanism of the first embodiment, the first holding member 240 has the pulley position restriction protrusion 249 that is a falling-off suppression structure that suppress the driven pulley 220 from falling off the first holding member 240, in a state of being not combined with the second holding member 250.

Therefore, the falling-off suppression structure provided to the first holding member 240 can temporally hold the driven pulley 220 on the first holding member 240, and in addition, the first holding member 240 can be combined with the second holding member 250 in such a temporally held state. As a result, the driven pulley 220 can be relatively easily assembled into the bearing position of the second holding member 250, and the assembly operation can be facilitated.

In addition, in the belt driving mechanism 200 of the first embodiment, the driven pulley 220 has the peripheral face 221 with a crowning shape. The crowning shape of the peripheral face 221 restricts the transmission belt 230, which is extended over the driven pulley 220, from slipping in the pulley width direction. Therefore, it is possible to suppress the meandering of the transmission belt 230, to maintain a state in which the transmission belt 230 is stably extended over the pulley, and to stably rotate the pulley.

Furthermore, in the belt driving mechanism 200 of the first embodiment, the driving pulley 210 is composed of the output shaft member 212 in the rotational driving unit. The output shaft member 212 is bearing-supported at a plurality of positions so as to interpose the transmission belt 230 extended over the driving pulley 210.

Therefore, the output shaft member 212 with the transmission belt 230 being extended over (the driving pulley 210) is supported by the bearings on both sides that interpose the transmission belt 230 being extended over. Accordingly, as a result of the tensile force from the transmission belt 230, the output shaft member 212 as the driving pulley 210 is unlikely to bend, and the transmission belt 230 can be suppressed from meandering that would be caused by toppling of the pulley due to bending of the axis. Therefore, it is easier to maintain a state in which the transmission belt 230 is stably extended over the pulley, and the pulley can be stably rotated.

Moreover, the driven pulley 220 of the first embodiment includes the driven-shaft member 223 that can be connected to the rotation center of the driven pulley 220, and the driven-shaft member 223 is bearing-supported at the plurality of positions so as to interpose the driven pulley 220. Therefore, the driven-shaft member 223 connected to the driven pulley 220 is supported by the bearings on both sides that interpose the driven pulley 220. Therefore, even if the tensile force from the transmission belt 230 is transmitted via the driven pulley 220, the driven-shaft member 223 is unlikely to bend, and the driven pulley 220 can be suppressed from toppling. In other words, it is possible to suppress the transmission belt 230 from meandering that would be caused by toppling of the driven pulley 220. Therefore, it is easier to maintain a state in which the transmission belt 230 is stably extended over the pulley, and the pulley can be stably rotated.

In addition, the printer 1 of the first embodiment includes the photosensitive drum 2 and the belt driving mechanism 200. The photosensitive drum 2 is directly or indirectly connected to one end side of the driven-shaft member 223. The photosensitive drum 2 is a single or plurality of image carriers. An electrostatic latent image is formed on the surface of the photosensitive drum 2. The belt driving mechanism 200 rotationally drives the single or plurality of photosensitive drum 2. Therefore, the belt driving mechanism 200 stably rotationally drives the driven-shaft member 223, and the single or plurality of the photosensitive drum 2 can be stably rotationally driven.

Next, a second embodiment is described. A belt driving mechanism 200A of the second embodiment is mainly different from the belt driving mechanism 200 of the first embodiment in configuration of the first holding member 240 and the second holding member 250. Regarding the second embodiment, points different from those of the first embodiment are mainly described, and descriptions of configurations similar to those of the first embodiment are omitted. The descriptions of the first embodiment are appropriately applied to or employed in points in the second embodiment that are not described in particular.

Figure 10:
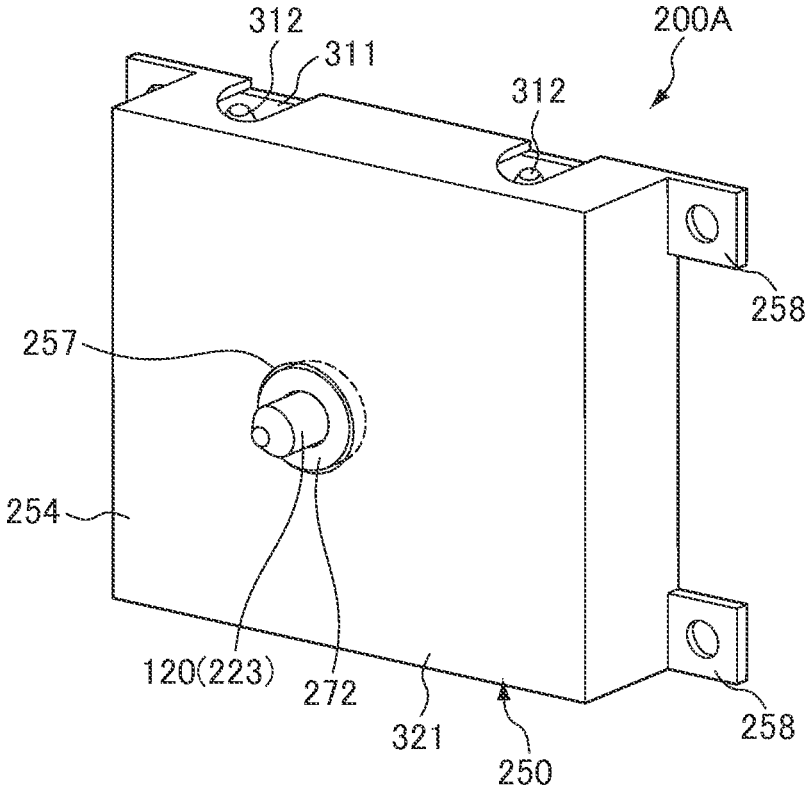
FIG. 10 is a perspective view showing a belt driving mechanism 200A as a second embodiment of the present invention, seen from the front face side.
Figure 11:
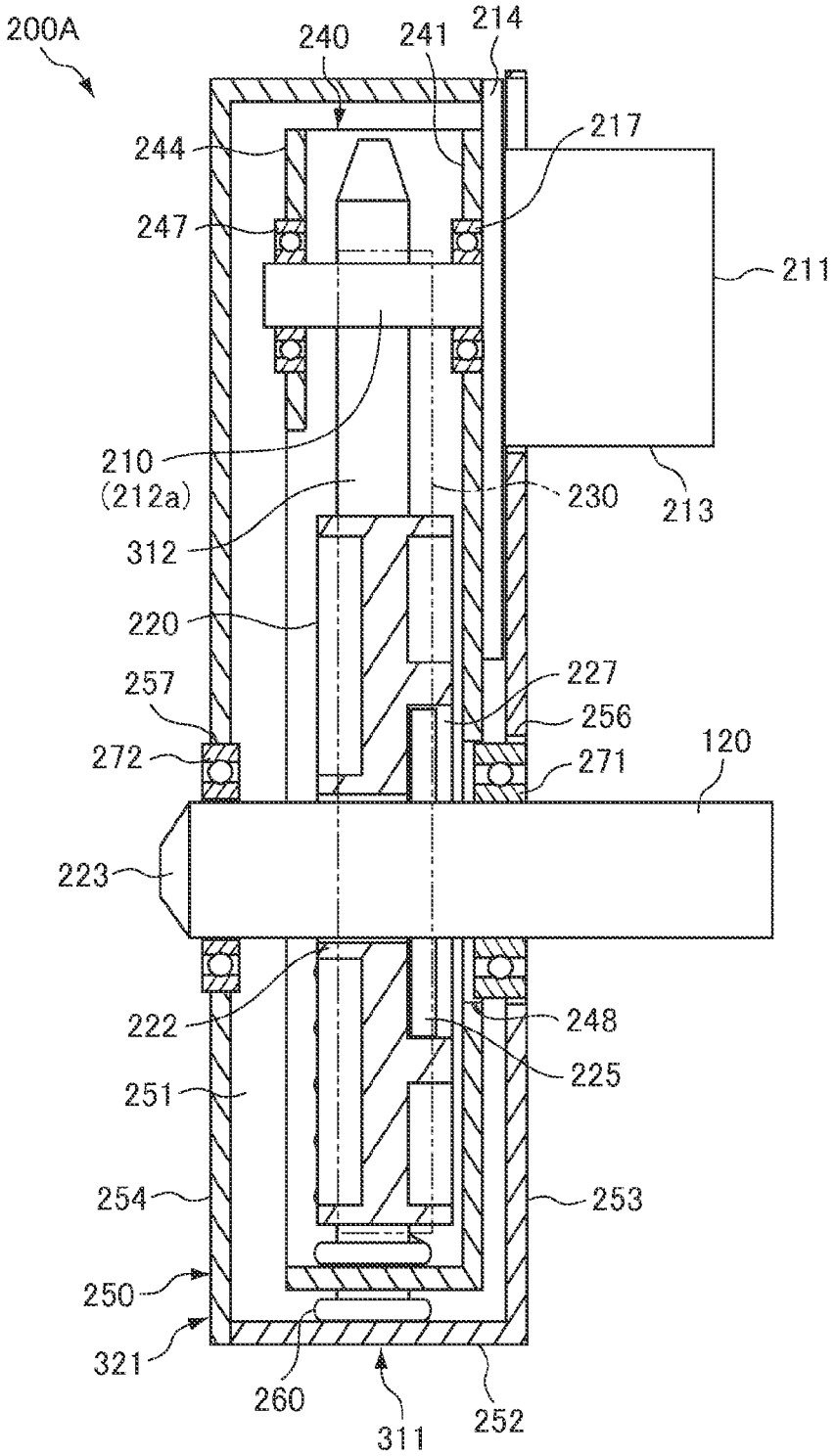
FIG. 11 is a vertical cross-sectional view showing the belt driving mechanism 200A illustrated in FIG. 10.
Figure 12:
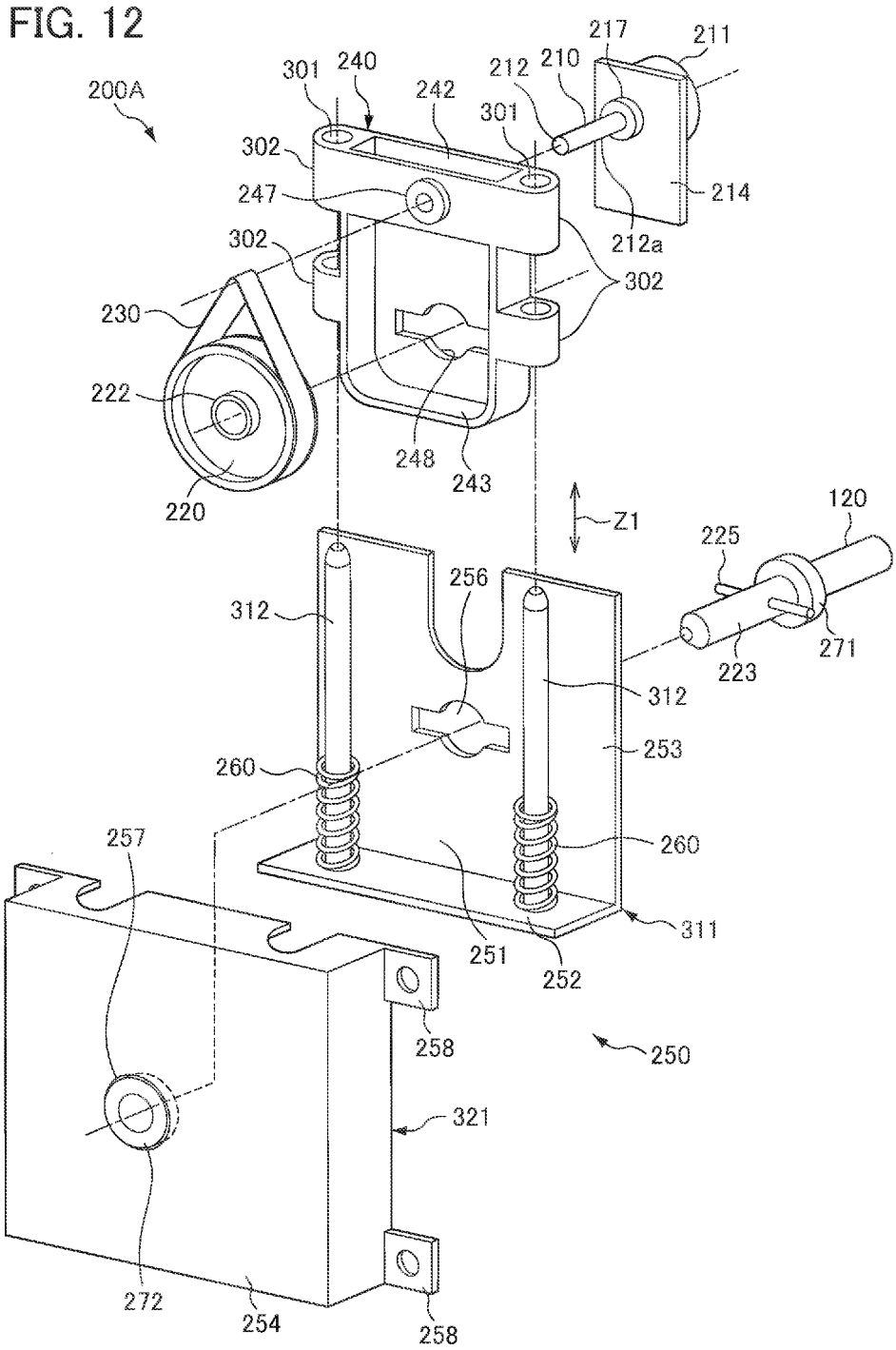
FIG. 12 is an exploded perspective view showing the belt driving mechanism 200A illustrated in FIG. 10.
Figure 13:
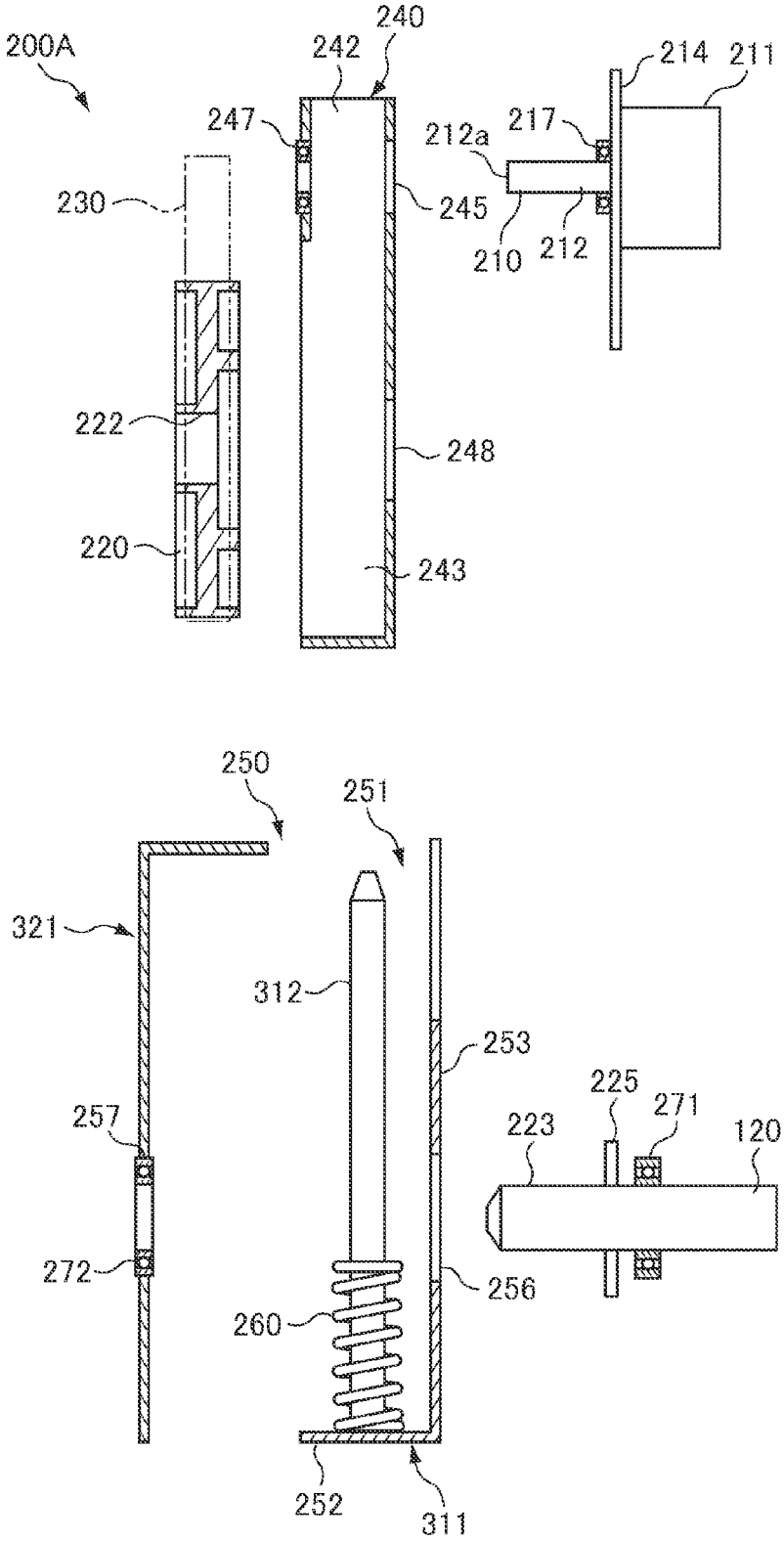
FIG. 13 is an exploded side view showing the belt driving mechanism 200A illustrated in FIG. 10.
Figure 14:
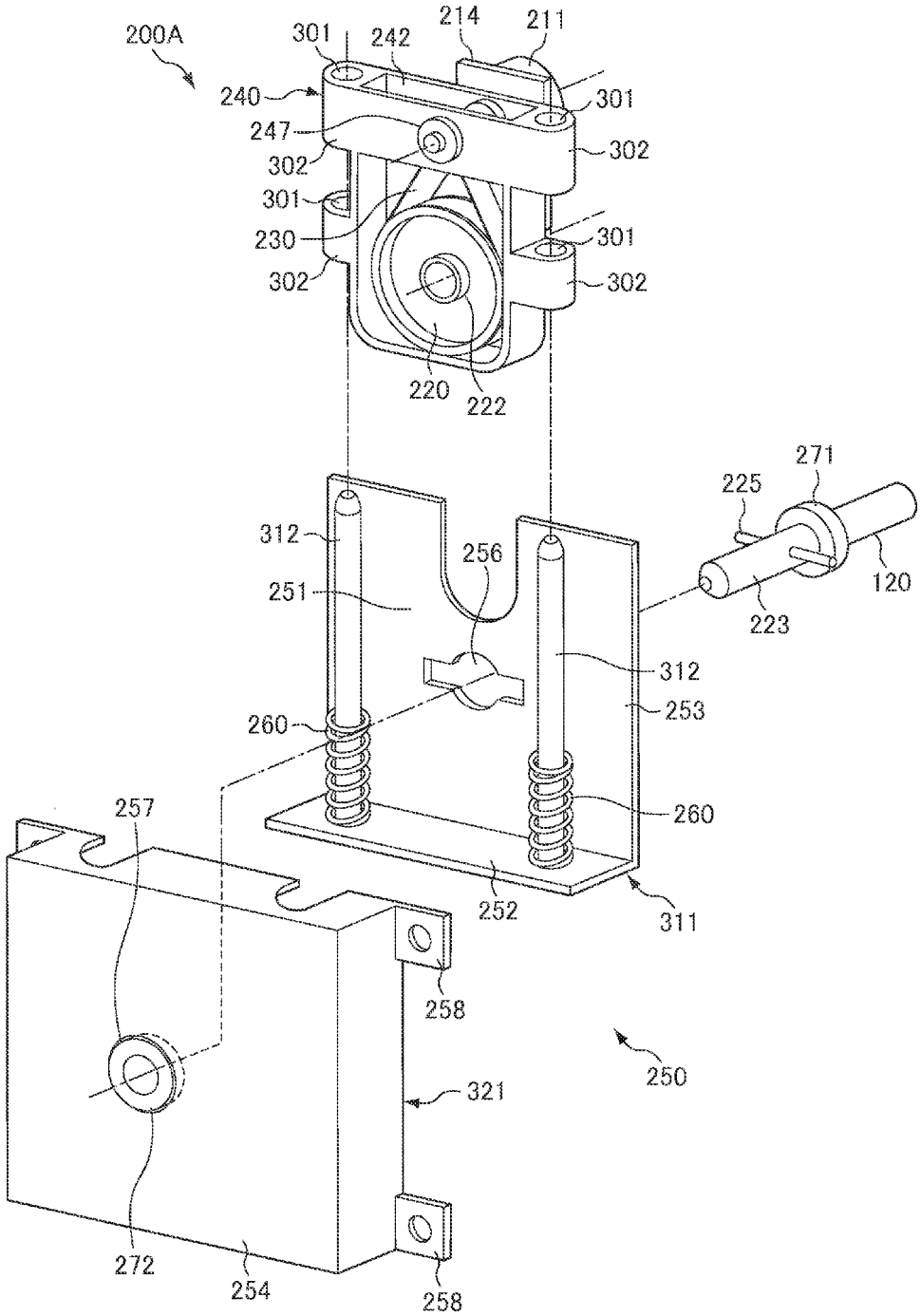
FIG. 14 is a perspective view showing each part illustrated in FIG. 12 in a partially assembled state.
Figure 15:
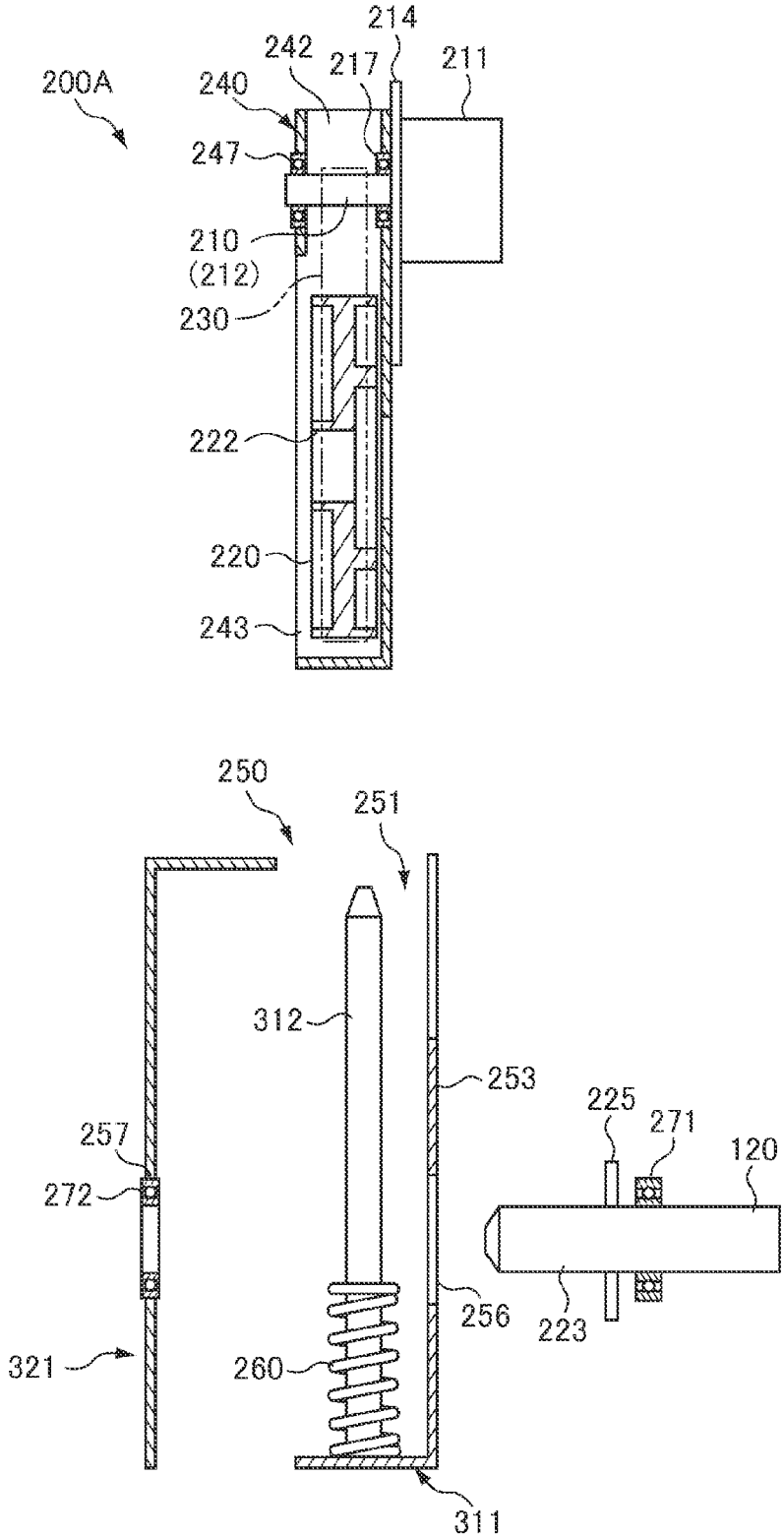
FIG. 15 is a side view showing an assembled state illustrated in FIG. 14.
Figure 16:
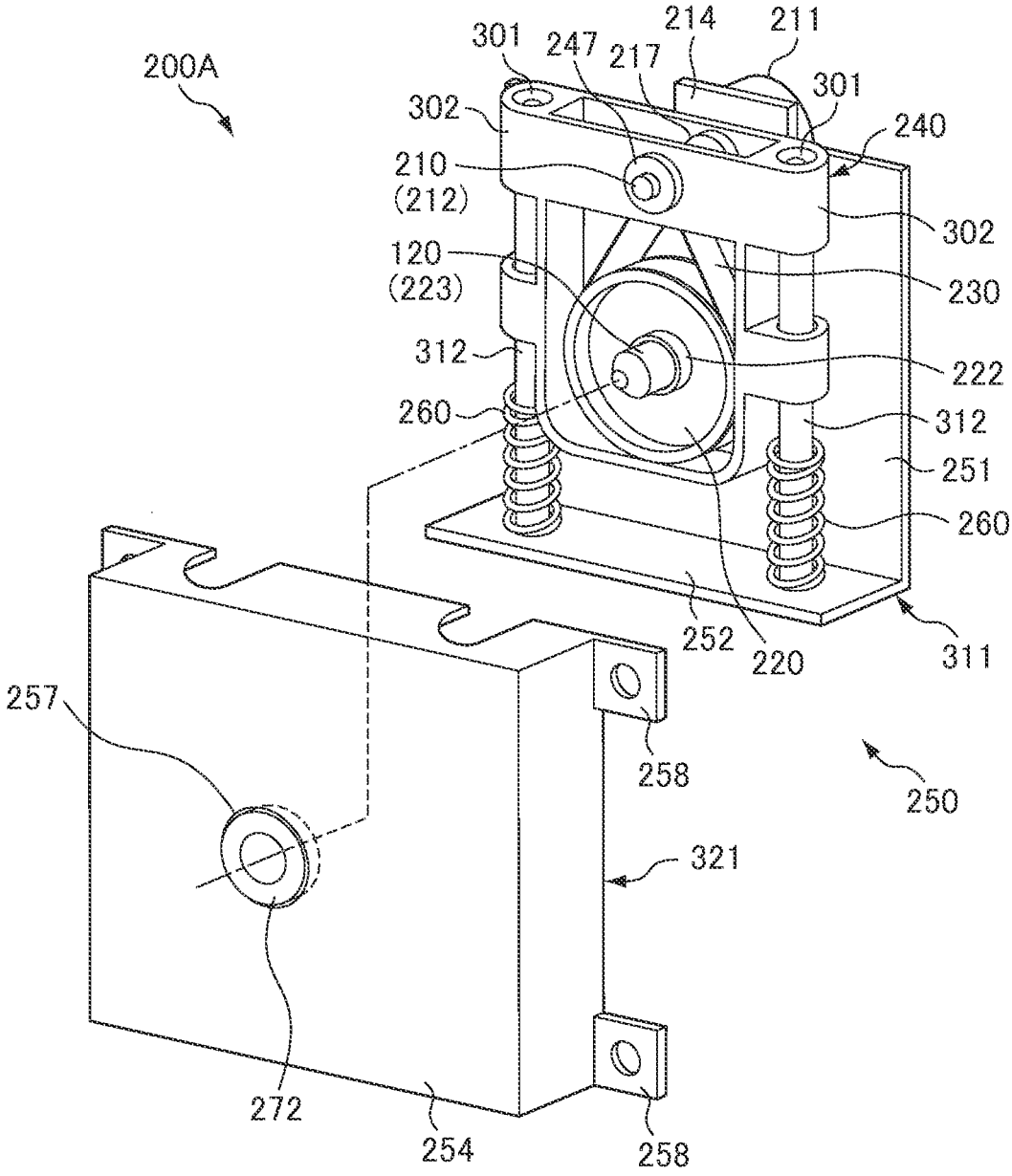
FIG. 16 is a perspective view showing a holding member main body 311 of the second holding member to which the first holding member 240 is fixed, and a cover member 321 of the second holding member, in a state before combining them.

FIG. 10 is a perspective view showing a belt driving mechanism 200A as the second embodiment of the present invention, seen from the front face side. FIG. 11 is a vertical cross-sectional view showing the belt driving mechanism 200A illustrated in FIG. 10. FIG. 12 is an exploded perspective view showing the belt driving mechanism 200A illustrated in FIG. 10. FIG. 13 is an exploded side view showing the belt driving mechanism 200A illustrated in FIG. 10. FIG. 14 is a perspective view showing each part illustrated in FIG. 12 in a partially assembled state. FIG. 15 is a side view showing an assembled state illustrated in FIG. 14. FIG. 16 is a perspective view showing a holding member main body 311 of a second holding member to which the first holding member 240 is installed, and a cover member 321 of the second holding member, in a state before combining them.

The first holding member 240 in the second embodiment is an integrally molded article made of resin. As shown in FIGS.

10 to 16, on both sides of the first holding member 240, attachment guiding parts 302 having attachment guiding holes 301 are provided so as to be separated in a vertical direction (direction indicated by a directional arrow Z1 in FIG. 12). Each of the attachment guiding holes 301 is a hole perforated along the vertical direction of the first holding member 240.

As shown in FIG. 12, the second holding member 250 in the second embodiment is not an integrally molded article, but is configured so as to be separated into: the holding member main body 311 to which the first holding member 240 is attached; and the cover member 321 attachable to the holding member main body 311.

The holding member main body 311 has a configuration in which the front wall 253 and the bottom wall 252 of the second holding member 250 in the first embodiment are integrally formed, and guiding shafts 312 are further implanted on the bottom wall 252.

The guiding shafts 312 are provided so as to extend upward from the bottom wall 252. Furthermore, the guiding shafts 312 are provided as a pair in a lateral direction so as to correspond to positions of the attachment guiding holes 301 on both sides of the first holding member 240. As a result of the guiding shafts 312 being slidably fitted into the attachment guiding holes 301 of first holding member 240, the first holding member 240 is guided to the bottom wall 252 side when the first holding member 240 is attached to the holding member main body 311. Moreover, as shown in FIG. 12, the biasing members 260 are inserted through and attached to the bottom side of the guiding shafts 312. The guiding shafts 312 also function as spring holding parts that hold the biasing members 260.

The cover member 321 is a housing that is substantially shaped like a box. As shown in FIG. 11, the cover member 321 is adapted it to be attached to the holding member main body 311. In such a state, the holding member main body 311 and the cover member 321 forms the accommodating portion 251 that accommodates the entirety of the first holding member 240.

The belt driving mechanism 200A of the second embodiment is assembled through the following procedure.

First, as shown in FIGS. 14 and 15, the driven pulley 220, the transmission belt 230 and the motor 211 are fixed to the first holding member 240, thereby assembling a partial assembly. Subsequently, the partial assembly is fixed to the holding member main body 311 as shown in FIG. 16, and the cover member 321 is further fixed to the holding member main body 311, thereby finishing a completed article as shown in FIG. 10.

The belt driving mechanism 200A of the second embodiment described above achieves the following effects in addition to the effects of the belt driving mechanism 200 of the first embodiment. In other words, in the belt driving mechanism 200A of the second embodiment, the guiding shafts 312 of the holding member main body 311 are fitted into the attachment guiding holes 301 provided on both sides of the first holding member 240, and in a manner such that the first holding member 240 is guided by the guiding shafts 312, the first holding member 240 is accommodated into the accommodating portion 251 of the second holding member 250. Therefore, the insertion operation of the first holding member 240 into the accommodating portion 251 becomes easy and reliable.

In addition, by appropriately setting the fitting tolerance of the guiding shafts 312 and the attachment guiding holes 301, the holding member main body 311 and the first holding member 240 can be in a combined state with less wobbling therebetween. Therefore, the performance of preventing toppling between the second holding member 250 and the first holding member 240 is improved. As a result, the effect of preventing toppling between the pulleys 210 and 220 is also improved, the mutual alignment of the pulleys can be maintained to be even more accurate, and the performance of suppressing the transmission belt 230 from meandering is improved.

Although preferred embodiments have been described above, the present invention is not limited to the aforementioned embodiments, and can be carried out in various modes.

For example, in the aforementioned embodiments, although the drum penetrating shaft member 120 of the photosensitive drum 2 is formed integrally with one end of the driven-shaft member, it is not limited thereto. The driven-shaft member 223 may be a shaft member different from the drum penetrating shaft member 120 of the photosensitive drum 2. In other words, the driven-shaft member 223 can be configured so as to be directly or indirectly connected to the drum penetrating shaft member 120.

Furthermore, in the aforementioned embodiments, although the drum penetrating shaft member 120 is configured with a single shaft member, it is not limited thereto. The drum penetrating shaft member 120 may configured by connecting two or more shaft members via coupling.

Moreover, in the belt driving mechanism according to the present invention, although rolling bearings are generally used as the bearings that rotatably support the output shaft member 212, the driven-shaft member 223 and the like (the first bearing member 217, the second bearing member 218, the third bearing member 247, the fourth bearing member 271, the fifth bearing member 272 and the like in the aforementioned embodiments), it is not limited thereto, and sliding bearings can also be used.

In addition, in each of the aforementioned embodiments, although the accommodating portion that accommodates the first holding member is provided to the second holding member, it is not limited thereto. An accommodating portion that accommodates the second holding member may be provided to the first holding member. In other words, the belt driving mechanism of the present invention may be configured such that any one of the first holding member and the second holding member includes an accommodating portion that can accommodate the entirety or part of an other one.

Furthermore, in the belt driving mechanism 200 of the first embodiment, the pulley position restriction protrusion 249 is provided to first holding member 240, and pulley position restriction protrusion 249 functions as both of the movement restriction part and the falling-off suppression structure. However, a configuration may be employed in which a member functioning as a movement restriction part and a member functioning as a falling-off suppression structure are separately provided.

Furthermore, a type of the image forming apparatus of the present embodiment is not limited in particular, and may be a copying machine, a printer, a facsimile, a multi-function device thereof, or the like.

The sheet-like transfer material is not limited to the sheet of paper T, and may be, for example, a film sheet.

What is claimed is:

1. A belt driving mechanism, comprising:

a driving pulley;

a driven pulley;

a looped transmission belt extended over the driving pulley and the driven pulley;

a first holding member that bearing-supports and holds the driving pulley;

a second holding member that bearing-supports and holds the driven pulley and is combined with the first holding member; and a biasing member that biases the first holding member and the second holding member so as to be separated, in a state in which the first holding member and the second holding member are combined wherein the second holding member comprises a plurality of walls, each wall of the second holding member conforms to shape of the first holding member and accommodates an entirety or part of the first holding member, and the plurality of walls of the second holding member substantially encloses the exterior of the first holding member in a state where the first holding member substantially resides inside the second holding member.

2. The belt driving mechanism according to claim 1, wherein the first holding member is composed of an integrally molded article made of resin, at least in portions other than bearings.

3. The belt driving mechanism according to claim 2, wherein the first holding member has a movement restriction part that restricts the transmission belt from moving in a width direction of the driven pulley in a case in which the transmission belt meanders.

4. The belt driving mechanism according to claim 1, wherein the first holding member has a falling-off suppression structure that suppress the driven pulley from falling off the first holding member in a state of being not combined with the second holding member.

5. The belt driving mechanism according to claim 1, wherein the driven pulley has a peripheral face with a crowning shape.

6. The belt driving mechanism according to claim 1, wherein the driving pulley is composed of an output shaft member in a rotational driving unit, and wherein the output shaft member is bearing-supported at a plurality of positions so as to interpose the transmission belt extended over the driving pulley in an axial direction of the output shaft member.

7. The belt driving mechanism according to claim 1, further comprising a driven-shaft member that can be connected to a rotation center of the driven pulley, wherein the driven-shaft member is bearing-supported at a plurality of positions so as to interpose the driven pulley in an axial direction of the driven-shaft member.

8. An image forming apparatus, comprising:

a single or plurality of image carriers directly or indirectly connected to one end side of the driven-shaft member, wherein an electrostatic latent image is formed on its surface; and the belt driving mechanism according to claim 7 that rotates the single or plurality of image carriers.

9. A belt driving mechanism, comprising:

a driving pulley;

a driven pulley;

a looped transmission belt extended over the driving pulley and the driven pulley;

a first holding member that bearing-supports and holds the driving pulley;

a second holding member that bearing-supports and holds the driven pulley and is combined with the first holding member; and a biasing member that biases the first holding member and the second holding member so as to be separated, in a state in which the first holding member and the second holding member are combined wherein the first holding member comprises a plurality of walls, each wall of the first holding member conforms to the shape of the second holding member and accommodates an entirety or part of the second holding member and the plurality of walls of the first holding member substantially encloses the exterior of the second holding member in a state where the second holding member substantially resides inside the first holding member.

* * * * *